US006352110B1

(12) United States Patent
Langseth et al.

(10) Patent No.: US 6,352,110 B1
(45) Date of Patent: Mar. 5, 2002

(54) METHOD AND APPARATUS FOR CONTINUOUSLY TESTING A WELL

(75) Inventors: Bjorn Langseth, Missouri City; Christopher W. Spiers; Dinesh R. Patel, both of Sugar Land, all of TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 09/552,910

(22) Filed: Apr. 20, 2000

Related U.S. Application Data

(63) Continuation-in-part of application No. 09/514,628, filed on Feb. 28, 2000, which is a continuation-in-part of application No. 09/512,438, filed on Feb. 25, 2000.

(60) Provisional application No. 60/130,589, filed on Apr. 22, 1999.

(51) Int. Cl.[7] ..... E21B 49/08

(52) U.S. Cl. ..... 166/264; 166/72

(58) Field of Search ..... 166/264, 100, 166/250.02, 321, 374, 72

(56) References Cited

U.S. PATENT DOCUMENTS

| | | | |
|---|---|---|---|
| 3,111,169 | A | 11/1963 | Hyde |
| 3,195,633 | A | 7/1965 | Jacob |

(List continued on next page.)

FOREIGN PATENT DOCUMENTS

| | | |
|---|---|---|
| EP | 0 022 357 | 1/1981 |
| EP | 0 176 410 | 4/1986 |
| EP | 0 481 866 A2 | 4/1992 |
| EP | 1 041 244 | 10/2000 |
| WO | WO 98/13579 | 4/1998 |
| WO | WO 98/36155 | 8/1998 |
| WO | WO 98/37307 | 8/1998 |
| WO | WO 98/48146 | 10/1998 |
| WO | WO 99/19602 | 4/1999 |
| WO | WO 99/24689 | 5/1999 |
| WO | WO 01/49973 | 7/2001 |

OTHER PUBLICATIONS

Aly, Ahmed; Characterizing Multi–Layer Reservoirs Using a Fast Computational Simulator and a New Environmentally Sensitive Pre–Production Well Test; Dissertation, Texas A&M University; Aug. 1995; p. 1–321.

Aly, Ahmed; Characterizing Multi–Layered Reservoirs Using a New, Simple, Inexpensive and Environmentally Sensitive Pre–Production Well Test; SPE 70$^{th}$ Annual Technical Conference and Exhibition, Dallas, Texas, Oct. 22–25, 1995.

(List continued on next page.)

*Primary Examiner*—Frank Tsay
(74) *Attorney, Agent, or Firm*—Trop Pruner & Hu P.C.

(57) ABSTRACT

One embodiment of my invention comprises a tool string for testing a wellbore formation that includes a production inlet, an injection outlet, and a sampler apparatus. Fluid is taken from a production zone, into the tool string through the production inlet, out of the tool string through the injection outlet, and into the injection zone. Within the interior of the tool string, the sampler apparatus takes samples of the fluid flowing therethrough. In another embodiment, a large volume of sample fluid is trapped within the interior of the tool string, such as between two valves, and is removed from the wellbore along with the tool string subsequent to the test. In another embodiment, the tool string includes at least one perforating gun to perforate one of the production and injection zones. The tool string may also include two perforating guns to perforate both the production and injection zones. One of the two perforating guns may be an oriented perforating gun so that upon activation the shape charges do not disturb any of the cables, data lines, or transmission lines associated with the tool string.

19 Claims, 20 Drawing Sheets

U.S. PATENT DOCUMENTS

| | | | |
|---|---|---|---|
| 3,294,170 | A | 12/1966 | Warren et al. |
| 3,305,014 | A | 2/1967 | Brieger |
| 3,611,799 | A | 10/1971 | Davis |
| 4,009,756 | A | 3/1977 | Zehren |
| 4,296,810 | A | 10/1981 | Price |
| 4,434,854 | A | 3/1984 | Vann et al. |
| 4,509,604 | A | 4/1985 | Upchurch |
| 4,535,843 | A | 8/1985 | Jageler |
| 4,560,000 | A | 12/1985 | Upchurch |
| 4,583,595 | A | 4/1986 | Czernichow et al. |
| 4,597,439 | A | 7/1986 | Meek |
| 4,633,945 | A | 1/1987 | Upchurch |
| 4,742,459 | A | 5/1988 | Lasseter |
| 4,745,802 | A | 5/1988 | Purfurst |
| 4,766,957 | A | 8/1988 | McIntyre |
| 4,770,243 | A | 9/1988 | Fouillout et al. |
| 4,803,873 | A | 2/1989 | Ehlig-Economides |
| 4,856,585 | A | 8/1989 | White et al. |
| 4,860,581 | A | 8/1989 | Zimmerman et al. |
| 5,006,046 | A | 4/1991 | Buckman et al. |
| 5,065,619 | A | 11/1991 | Myska |
| 5,170,844 | A | 12/1992 | George et al. |
| 5,337,821 | A | 8/1994 | Peterson |
| 5,348,420 | A | 9/1994 | Bernhardt |
| 5,353,870 | A | 10/1994 | Harris |
| 5,361,839 | A | 11/1994 | Griffith et al. |
| 5,425,416 | A | 6/1995 | Hammeke et al. |
| 5,540,280 | A | 7/1996 | Schultz et al. |
| 5,555,945 | A | 9/1996 | Schultz et al. |
| 5,655,605 | A | 8/1997 | Matthews |
| 5,762,149 | A | 6/1998 | Donovan et al. |
| 5,799,733 | A | 9/1998 | Ringgenberg et al. |
| 5,803,186 | A | 9/1998 | Berger et al. |
| 5,826,662 | A | 10/1998 | Beck et al. |
| 5,887,652 | A | 3/1999 | Beck et al. |

OTHER PUBLICATIONS

Aly, Ahmed, and Lee, W. John; Characterizing Multi–Layered Reservoirs Using a New, Simple, Inexpensive and Environmentally Sensitive Pre–Production Well Test; SPE Annual Technical Conference and Exhibition, Denver, Colorado; Oct. 5–9, 1996.

Shore–Tec AS; Downhole Production Testing; Downhole Production Testing Development Project; Jun. 17, 1997.

Woie, Rune; Downhole Pump for Well TestingDownhole Pump for Well Testing; WTN: New Formation Evaluation Tools Workshop; Apr. 27–29, 1998.

Antropov, A.D. and Galiev, N.S. and Elizarov, A.V. and Maksimov, V.P.; Results of Testing the Downhole Unit for Water Injection Between Formations on the Trekhozernoe Oilfield; Gipro Tyumen Nefte Gaz, Oil Producing Department "Shaimneft".

METHOD AND APPARATUS FOR CONTINUOUSLY TESTING A WELL

This application is a continuation-in-part of U.S. Non-Provisional application Ser. No. 09/514,628 filed by Langseth on Feb. 28, 2000 and entitled "Method and Apparatus for Continuously Testing a Well", which application is a continuation-in-part of U.S. Non-Provisional application Ser. No. 09/512,438 filed by Langseth, Spiers, Patel, and Vella on Feb. 25, 2000 and entitled "Method and Apparatus for Testing a Well", which application claims priority under 35 U.S.C. §119(e) to U.S. Provisional Application Serial No. 60/130,589, entitled "Method and Apparatus for Testing a Well," filed Apr. 22, 1999.

BACKGROUND

This invention relates to methods and apparatus for testing wells.

After a wellbore has been drilled, testing (e.g., drillstem testing or production testing) may be performed to determine the nature and characteristics of one or more zones of a formation before the well is completed. Characteristics that are tested for include the permeability of a formation, volume, pressure, skin, and temperature of a reservoir in the formation, fluid content of the reservoir, and other characteristics. To obtain the desired data, fluid samples may be taken as well as measurements made with downhole sensors and other instruments.

One type of testing that may be performed is a conventional drillstem test. A drillstem test is a test taken through the drillstem by means of special testing equipment attached to the drillstem. The special equipment, which may include pressure and temperature sensors and fluid identifiers, determines if fluid components in commercial quantities have been encountered in the wellbore. The fluid components are normally then produced to the surface and are either flared or transported to storage containers. Producing the fluid components to the surface at the testing stage, and particularly flaring the fluid components at the surface, creates a potential environmental hazard and is quickly becoming a discouraged practice.

Another type of testing that may be performed is a closed-chamber drillstem test. In a closed-chamber test, the well is closed in at the surface when producing from the formation under test. Instruments may be positioned downhole and at the surface to make measurements. One advantage offered by closed-chamber testing is that hydrocarbons and other well fluids are not produced to the surface during the test. This alleviates some of the environmental concerns associated with having to burn off or otherwise dispose of hydrocarbons that are produced to the surface. However, conventional closed-chamber testing is limited in its accuracy and completeness due to limited flow of fluids from the formation under test. The amount of fluids that can be produced from the zone under test may be limited by the volume of the closed chamber.

A further issue associated with testing a well is communication of test results to the surface. Some type of mechanism is typically preferred to communicate real-time test data to well surface equipment. One possible communications mechanism is to run an electrical cable down the wellbore to the sensors. An alternative to real-time data gathering is to utilize downhole recorders that record the downhole sensor data and are subsequently retrieved to the surface after the test.

In addition, when testing is conducted in a cased wellbore, the casing must be perforated in order to flow the hydrocarbons into the wellbore. Perforating methods used to perforate the appropriate zones include wireline and tubing conveyed perforating. If tubing conveyed, the perforating guns are run downhole attached to the testing instruments. If wireline conveyed, the perforating guns are run first, and the testing instruments are deployed downhole once the guns are removed from the wellbore. The perforating jobs tend to be more intricate if more than one zone needs to be perforated within the wellbore.

A need thus exists for an improved method and apparatus for testing wells.

SUMMARY

One embodiment of my invention comprises a tool string for testing a wellbore formation that includes a production inlet, an injection outlet, and a sampler apparatus. Fluid is taken from a production zone, into the tool string through the production inlet, out of the tool string through the injection outlet, and into the injection zone. Within the interior of the tool string, the sampler apparatus takes samples of the fluid flowing therethrough. In another embodiment, a large volume of sample fluid is trapped within the interior of the tool string, such as between two valves, and is removed from the wellbore along with the tool string subsequent to the test. In another embodiment, the tool string includes at least one perforating gun to perforate one of the production and injection zones. The tool string may also include two perforating guns to perforate both the production and injection zones. One of the two perforating guns may be an oriented perforating gun so that upon activation the shape charges do not disturb any of the cables, data lines, or transmission lines associated with the tool string.

DETAILED DESCRIPTION

In the following description, numerous details are set forth to provide an understanding of the present invention. However, it will be understood by those skilled in the art that the present invention may be practiced without these details and that numerous variations or modifications from the described embodiments may be possible.

As used here, the terms "up" and "down"; "upper" and "lower"; "upwardly" and "downwardly"; "below" and "above"; and other like terms indicating relative positions above or below a given point or element are used in this description to more clearly describe some embodiments of the invention. However, when applied to equipment and methods for use in wells that are deviated or horizontal, such terms may refer to a "left to right" or "right to left", or other relationship as appropriate. Further, the relative positions of the referenced components may be reversed.

Figure 1:
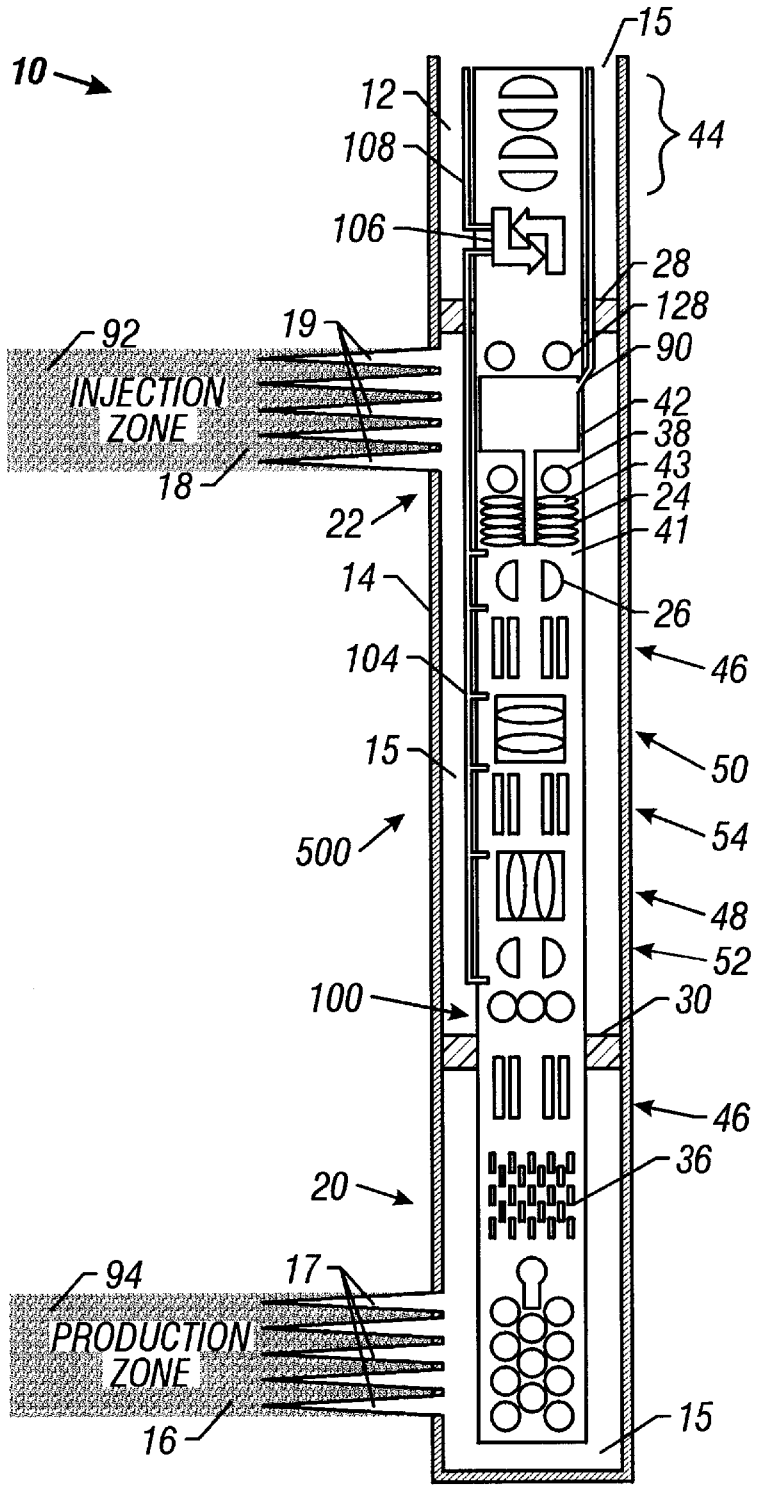
FIG. 1 illustrates one embodiment of the tool string disposed in a wellbore.

One embodiment of the tool string 10 of this invention is illustrated in FIG. 1. Tool string 10 is positioned in a wellbore 12 that may be lined with a casing 14. The wellbore 12 may include a production zone 16 and an injection zone 18 and may be a part of a subsea well or a land well. Tool string 10 is designed to perform an extensive flow test collecting data and oil samples without producing formation fluids to the surface. Tool string 10 is capable of conducting long flow periods and build up periods to evaluate reservoir limits or boundaries. In one embodiment, tool string 10 provides real time surface readout of all the data collected during the flow and shut-in phases. In the preferred embodiment, tool string 10 has a modular design wherein different components may be added to or removed from the tool string 10 at the discretion of the operator.

Tool string 10 may be conveyed by tubing, wireline, or coiled tubing, depending on the requirements of the operator and/or the depth of operation. In the preferred embodiment, the casing 14 adjacent production zone 16 is perforated with production zone perforations 17, and the casing 14 adjacent injection zone 18 is perforated with injection zone perforations 19.

In the embodiment of FIG. 1, tool string 10 includes a production inlet 20, an injection outlet 22, a pump 24, and a flow valve 26. Generally, pump 24 when activated causes production zone fluid to flow from the production zone 16 through the production zone perforations 17, into the tool string 10 through the production inlet 20, through the tool string 10 interior, out of the tool string 10 through the injection outlet 22, and into the injection zone 18 through the injection zone perforations 19. Flow valve 26 controls the flow of fluid through the interior of tool string 10.

Figure 2:
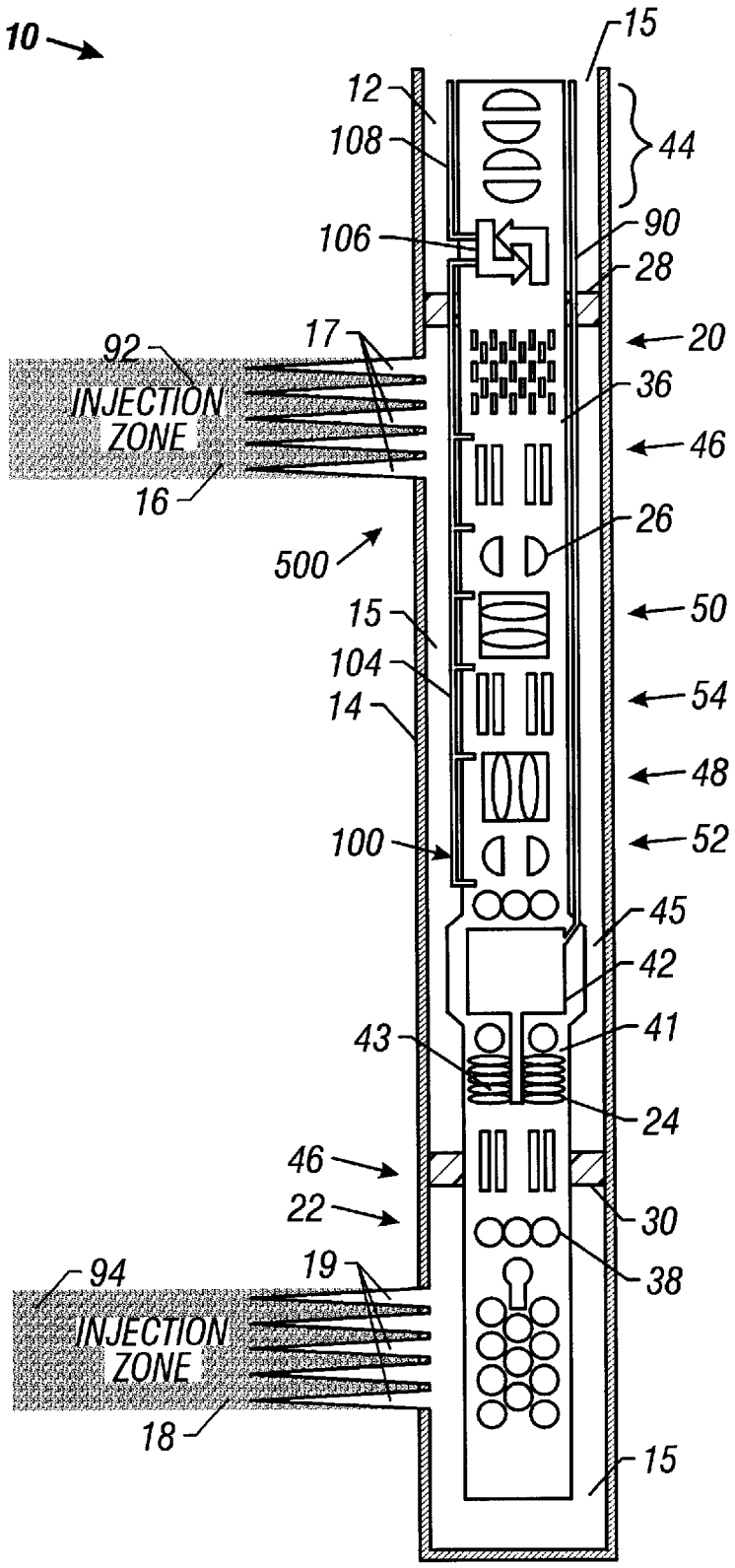
FIG. 2 illustrated another embodiment of the tool string disposed in a wellbore.

Tool string 10 may be used to induce flow from a lower production zone 16 to a higher injection zone 18 as shown in FIG. 1 or from a higher production zone 16 to a lower injection zone 16 as shown in FIG. 2. For purposes of brevity, the higher of the production zone 16 and the injection zone 18 will hereinafter be referred to as the upper zone 92, and the lower of the production zone 16 and the injection zone 18 will hereinafter be referred to as the lower zone 94. Thus, for example, in FIG. 1, the injection zone 18 is the upper zone 92, and the production zone 18 is the lower zone 94. On the other hand, in FIG. 2, the production zone 18 is the upper zone 92, and the injection zone 18 is the lower zone 94.

Tool string 10 preferably includes an upper sealing element 28 and a lower sealing element 30, which each may comprise packers. Upper sealing element 28 is positioned above the upper zone 92, isolating the upper zone 92 from the remainder of the annulus 15 uphole of the upper sealing element 28. Lower sealing element 30 is positioned between the upper zone 92 and the lower zone 94, isolating the upper zone 92 from the lower zone 94. As is well-known in the art, upper sealing element 28 and lower sealing element 30 are adapted to move into sealing engagement with the wellbore 12 or casing 14 upon their actuation.

Figure 3:
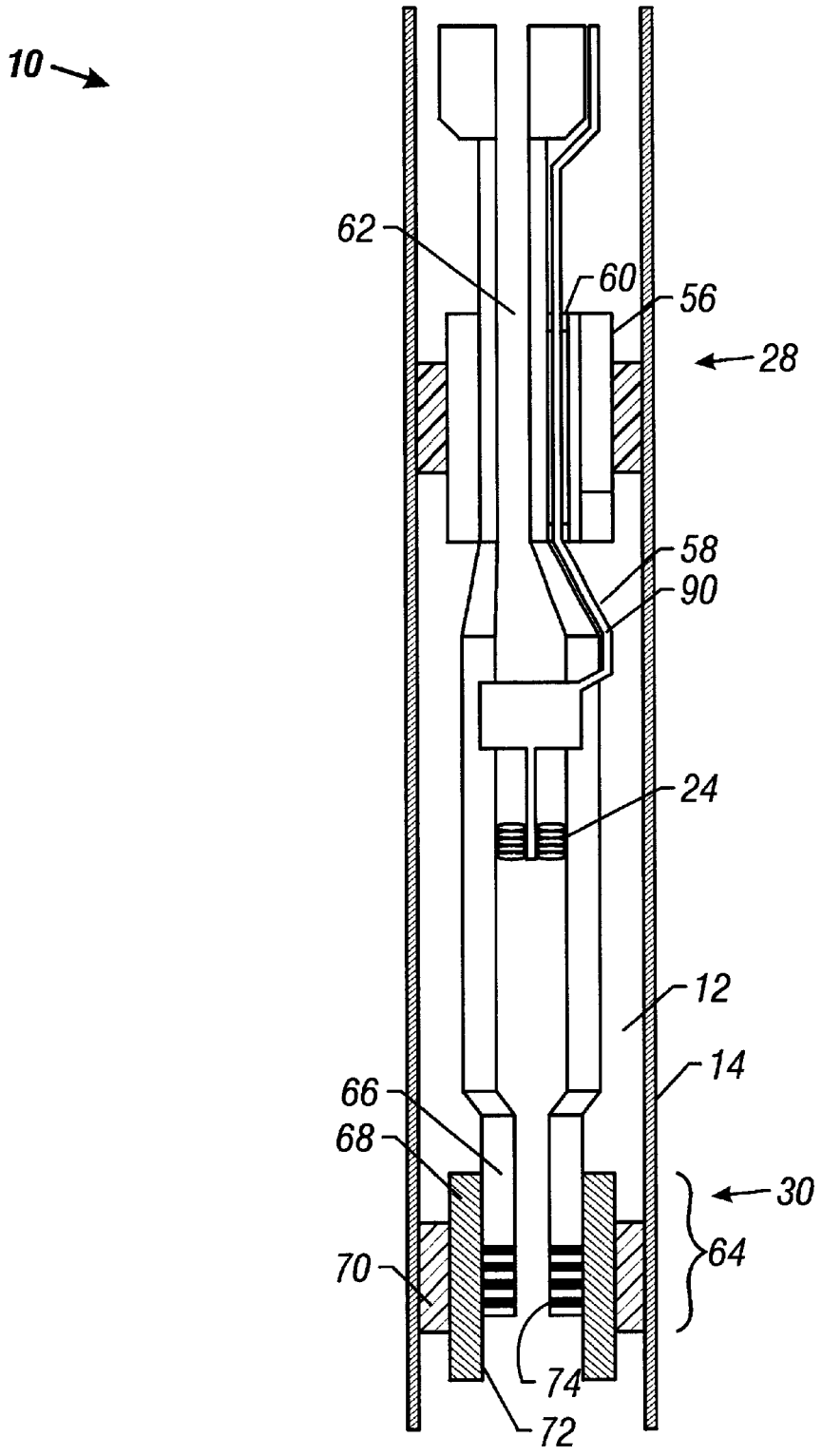
FIG. 3 illustrates an embodiment of the tool string, including a multi-port packer as the upper sealing element and a packer stinger assembly as the lower sealing element.

In one embodiment as best shown in FIG. 3, upper sealing element 28 comprises a multi-port packer 56 that allows access to power and data cables and transmission lines 58 below the upper sealing element 28. As is known in the art, multiport packers 56 include secondary ports 60 through their body in addition to the main bore 62. The secondary ports 60 are used to pass cables or transmission lines 58 therethrough, which cables and lines 58 are operatively connected to the tools and sensors below the upper sealing element 28, as will be described herein.

In one embodiment, lower sealing element 30 comprises a packer stinger assembly 64. Packer stinger assembly 64 includes a stinger portion 66 and a packer body portion 68. Packer body portion 68 includes the sealing elements 70 that seal with the wellbore 12 or casing 14 as well as packer body portion bore 72. Stinger portion 66 is connected to the remainder of tool string 10 and is sized and constructed to be inserted into the packer body portion bore 72. A packer stinger assembly seal 74, disposed either on stinger portion 66 or packer body portion 68, enables the sealing engagement of the stinger portion 66 within the packer body portion 68.

Packer stinger assembly 64 is beneficial because the lower sealing element 30 can be exposed to debris and sand from the formation located above it. The debris and sand could fill up the annular region between the lower sealing element 30 and the casing 14 or wellbore 12, which could prevent the subsequent retrieval of the lower sealing element 30. If the packer stinger assembly 64 is used, the stinger portion 66 can be easily retrieved by disengaging it from the packer body portion 68, and the packer body portion 68 can be subsequently removed with a specialized fishing tool. In addition, packer stinger assembly 64 is beneficial because the engagement between the stinger portion 66 and the packer body portion 68 compensates for any tubing movement between the upper sealing element 28 and the lower sealing element 30.

Production inlet 20 provides fluid communication between the annulus 15 region adjacent the production zone 16 and the interior of the tool string 10. In the embodiment shown in FIG. 1, production inlet 20 is located below the lower sealing element 30 and provides fluid communication between the annulus 15 region below the lower sealing element 30 and the interior of the tool string 10. In the embodiment shown in FIG. 2, production inlet 20 is located intermediate the upper sealing element 28 and the lower sealing element 30 and provides fluid communication between the interior of the tool string 10 and the annulus 15 region that is intermediate the upper sealing element 28 and the lower sealing element 30.

In the preferred embodiment, production inlet 20 comprises a section of production slotted tubing 36 on tool string 10. Production inlet 20 may also comprise ported tubing (not shown in the Figures). In the preferred embodiment production inlet 20 includes a filter mechanism, gravel pack, or other sand control means, which prohibits flow of particles that are greater than a pre-determined size. The filter mechanism may comprise a filter screen on the production inlet 20 or the construction of the slots of the production slotted tubing 36 or the ports of the ported tubing being the certain predetermined size.

Injection outlet 22 provides fluid communication between the annulus 15 region adjacent the injection zone 18 and the interior of the tool string 10. In the embodiment shown in FIG. 1, injection outlet 22 is located intermediate the upper sealing element 28 and the lower sealing element 30 and provides fluid communication between the interior of the tool string 10 and the annulus 15 region intermediate the upper sealing element 28 and the lower sealing element 30. In the embodiment shown in FIG. 2, injection outlet 22 is located below the lower sealing element 30 and provides fluid communication between the interior of the tool string 10 and the annulus 15 region that is below the lower sealing element 30. In either embodiment, injection outlet 22 is preferably located on the pressure end 43 of pump 24.

In the preferred embodiment, injection outlet 22 comprises a section of ported tubing 38 on tool string 10. Injection outlet 22 may also comprise slotted tubing (not shown in the Figures). In one embodiment injection outlet 22 includes a filter mechanism, gravel pack, or other sand control means, which prohibits flow of particles that are greater than a pre-determined size. The filter mechanism may also comprise a filter screen on the injection outlet 22 or the construction of the slots of the injection slotted tubing or the ports of the ported tubing being the certain predetermined size.

Pump 24 preferably comprises a submersible pump that is operatively connected to an electric motor 42. Pump 24 may, however, also comprise other types of pumps. A power cable 90 extends through upper sealing element 28, such as through one of the secondary ports 60 of multi-port packer 56, and is operatively connected to motor 42.

In the embodiment illustrated in FIG. 1 in which the injection zone 18 is the upper zone 92, the pump 24 is preferably positioned higher up on the tool string 10 so that motor 42 is proximate and preferably below the injection zone 18. The flow of fluid around motor 42 serves to cool the motor 42 during operation. Also preferably and in the embodiment of FIG. 1, pump 24 is located so that flow valve 26 is on the suction end 41 of pump 24 and flow valve 26 is downhole of pump 24.

In the embodiment illustrated in FIG. 2 in which the production zone 16 is the upper zone 92, pump 24 is preferably positioned lower in the tool string 10 so that pump 24 is downhole of sampling valve 52, which will be described herein, and the suction end 41 of pump 24 is proximate sampling valve 52. Preferably, motor 42 is disposed intermediate pump 24 and sampling valve 52. In this embodiment, pump 24 may also require a shroud 45 around motor 42 to communicate the suction side 41 of pump 24 to the remainder of the tool string 10 uphole of motor 42.

Flow valve 26 is located within tool string 10 intermediate the production inlet 20 and the injection outlet 22. In the preferred embodiment, flow valve 26 comprises a ball valve that defines a full bore through tool string 10 in the open position and prohibits flow through tool string 10 in the closed position. Flow valve 26 may also comprise other types of valves such as flapper valves or disc valves.

Tool string 10 may also comprise a barrier valve mechanism 44 located uphole of the injection outlet 22 in the embodiment of FIG. 1 and uphole of the production inlet 20 in the embodiment of FIG. 2. In the closed position, barrier valve mechanism 44 prohibits flow to the surface during the operation of tool string 10. In one embodiment, barrier valve mechanism 44 comprises a ball valve that defines a full bore through tools string 10 in the open position and prohibits flow through tool string 10 in the closed position. Barrier valve mechanism 44 may also comprise two ball valves in series, such as the Schlumberger IRIS Safety Valve, one valve being a cable cutting valve and the second valve being a sealing valve. In another embodiment, barrier valve mechanism 44 comprises a ball valve, which selectively prohibits flow through the tool string 10, and a circulation valve, which selectively enables flow from the interior of the tool string 10 to the annulus 15, such as the Schlumberger IRIS Dual Valve. Barrier valve mechanism 44 is preferably operated from the surface by means known in the art, such as pressure pulse telemetry or control lines.

Preferably, tool string 10 also comprises a sampling valve 52 located downhole of the flow valve 26 and above the production inlet 20 in the embodiment of FIG. 1 or above the injection outlet in the embodiment of FIG. 2. Preferably, sampling valve 52 comprises a ball valve that defines a full bore through tool string 10 in the open position and prohibits flow through tool string 10 in the closed position.

In one embodiment, tool string 10 also comprises a circulating valve 100 located below sampling valve 52 and above lower sealing element 30. Circulating valve 100 may comprise a sleeve valve, provides fluid communication between the interior of the tool string 10 and the annulus 15 when in the open position, and prohibits fluid communication between the interior of the tool string 10 and the annulus 15 when in the closed position. In one embodiment, sampling valve 52 and circulating valve 100 comprise a Schlumberger IRIS Dual Valve that includes one ball valve and one sleeve valve.

Tool string 10 may also include at least one pressure and temperature unit 46, each unit 46 including at least one and preferably a plurality of pressure and temperature sensors for recording and monitoring the pressure and temperature of the fluid flowing through the interior of tool string 10. Preferably, pressure and temperature units 46 are located intermediate the production inlet 20 and the injection outlet 22. Preferably, tool string 10 includes at least two pressure and temperature units 46, one unit 46 proximate the production zone 16 and the other unit 46 proximate the injection zone 18. It is also noted that the units 46 may be constructed to take measurements of fluid either in the interior of the tool string 10 or in the annulus 15. It is noted that the data taken by the pressure and temperature units 46 has a number of uses, including to modify the flow rate of the fluid within tool string 10 so that its fluid pressure does not drop below the bubble point.

Tool string 10 may also include a flow meter 48 for recording and monitoring the flow rate of the fluid flowing through the interior of tool string 10. Flow meter 48 is located intermediate the production inlet 20 and the injection outlet 22.

Tool string 10 may also include a fluid identifier 50, preferably including an optical fluid analyzer, for recording and monitoring the oil content in the fluid flowing through the interior of tool string 10. Fluid identifier 50 is preferably able to take at least two measurements: visible and near-infrared absorption for fluid composition and change in index of refraction for gas composition. Fluid identifier 50 is located intermediate the production inlet 20 and the injection outlet 22.

Tool string 10 may also include a solid detector (not shown) for detecting solids, such as sand, flowing from the production zone 16 or a fluid density meter (not shown) for monitoring the density of the fluid from the production zone 16. Solid detector and fluid density meter may be located intermediate the production inlet 20 and the injection outlet 22. Other sensors or meters that may be included are $H_2S$ detectors, $CO_2$ detectors, and water cut meters.

In the preferred embodiment, tool string 10 also includes a sampler apparatus 54 that contains at least one PVT sample chamber. Sampler apparatus 54 is preferably part of the tool string 10, as opposed to being run on slick line or wireline independent of the tool string 10. Sampler apparatus 54 preferably includes a plurality of PVT sampler chambers. The plurality of sampler chambers may be triggered all at once or at separate times. Sampler apparatus 54 is located intermediate the production inlet 20 and the injection outlet 22. Sampler apparatus 54 may also include an activation verification mechanism (not shown) which automatically signals at the surface when the sampler apparatus has successfully obtained a sample of fluid. Activation verification mechanism may comprise a pressure sensor within each sampler chamber or a switch triggered upon the stroke of the sampler chamber mechanism.

A data line 104 is preferably run from the surface of the wellbore 12 to the tool string 10. Data line 104 is preferably in communication with the pressure and temperature units 46, the flow meter 48, the fluid identifier 50, the solid detector, the fluid density meter, and the other meters/sensors. It is noted that data line 104 must pass through the upper sealing element 28 and preferably does so by way of one of the secondary ports 60 of the multi-port packer 56. Data line 104 transmits the readings of the pressure and temperature units 46, the flow meter 48, the fluid identifier 50, the solid detector, the fluid density meter, and the other meters/sensors to the surface, preferably continuously but at the least in time intervals. Moreover, in one embodiment, data line 104 and the instruments, 46, 48, and 50 (and the other meters/sensors), are constructed so that signals may be sent from the surface to the instruments, 46, 48, and 50 (and the other meters/sensors), which signals can modify characteristics of the instruments such as data tolerances or the time intervals at which readings are taken. As an example, data line 104 may comprise a fiber optic line.

In one embodiment, tool string 10 also includes a communication component 106 preferably located above the upper sealing element 28. Alternatively, communication component 106 may be located anywhere on the tool string 10. Data line 104, in this embodiment, extends from the communication component 106 to each instrument, 46, 48, and 50 (and the other meters/sensors). A transmission line 108 extends from the communication component 106 to the surface. All signals from the surface pass through the transmission line 108 and are interpreted by the communication component 106, which then operates the relevant instrument, 46, 48, and 50 (and the other meters/sensors), appropriately by sending a signal through data line 104. All signals from the instruments, 46, 48, and 50 (and the other meters/sensors), pass through data line 104 and are interpreted by the communication component 106, which then relays the information to the surface through the transmission line 108. As an example, transmission line 108 may comprise a fiber optic line.

In another embodiment, instead of including data line 104, tool string 10 includes at least one recorder (not shown) for recording the data taken by the pressure and temperature units 46, the flow meter 48, the fluid identifier 50, the solid detector, the fluid density meter, and the other meters/sensors. In this embodiment, the data is recorded while the tool string 10 is downhole and is then retrieved once the tool string 10 is removed from the wellbore 12. Tool string 10 may include a separate recorder for each of the relevant instruments.

The flow valve 26, sampling valve 52, and circulating valve 100 are, as illustrated in the Figures, located below upper sealing element 28. There are several ways in which the flow valve 26, sampling valve 52, and circulating valve 100 can be operated from above the upper sealing element 28.

In one embodiment (not shown in the Figures), at least one passageway provides communication from above the upper sealing element 28 to the valves, 26, 52, and/or 100. In the preferred embodiment, the passageway comprises a hydraulic line that is passed through the upper sealing element 28 (such as through a secondary port 60 of the multi-port packer 56) and is operatively connected to the valves, 26, 52, and 100. In one embodiment, the hydraulic line extends to the surface and pressure therein operates the valve. In another embodiment, the hydraulic line is open to the annulus 15 above the upper sealing element 28. In this embodiment, hydraulic pressure in the line applied to the annulus 15 above the upper sealing element 28 acts to operate the flow valve 26, sampling valve 52, and circulating valve 100. Each valve may have its own independent hydraulic line. In another embodiment, one hydraulic line is connected to the valves.

Figure 4:
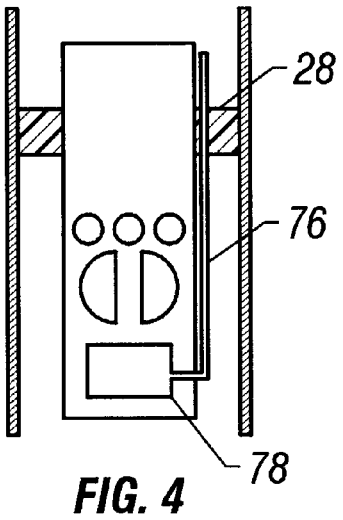
FIG. 4 illustrates one embodiment for operating the valves located below the upper sealing element.

In another embodiment as shown in FIG. 4, tool string 10 includes a local telemetry bus 76 and an interface module 78. Local telemetry bus 76, which may correspond to data line 104, extends through upper sealing element 28 and communicates with interface module 78. Interface module 78 is operatively connected to a valve, 26, 52, or 100. Local telemetry bus 76 is capable of handling data transfer and tool operation commands. A command signal from the surface sent through the local telemetry bus 76 is received by the interface module 78. Interface module 78 interprets the command signal and responds by operating the valve, 26, 52, or 100, in the appropriate manner. Additionally, tool status may be sent through local telemetry bus 76 from the downhole environment to the surface. In one embodiment, each valve, 26, 52, or 100, has its own independent local telemetry bus. In another embodiment, all of the valves, 26, 52, and 100, operate through one local telemetry bus. In a further embodiment, each valve, 26, 52, or 100, has its own interface module. In another embodiment, all of the valves, 26, 52, and 100, operate through one interface module.

Figure 5:
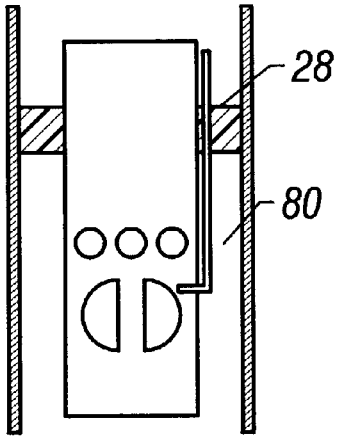
FIG. 5 illustrates another embodiment for operating the valves located below the upper sealing element.

In another embodiment as shown in FIG. 5, tool string 10 includes a direct control line 80, which may correspond to data line 104, that extends through upper sealing element 28 and is in direct communication with solenoids that operate the valves, 26, 52, and 100. Electric pulses sent through the direct control line 80 are used to operate the solenoid valves. In one embodiment, each valve, 26, 52, or 100, has its own independent direct control line. In another embodiment all of the valves, 26, 52, and 100, are operated by one direct control line.

Figure 6:
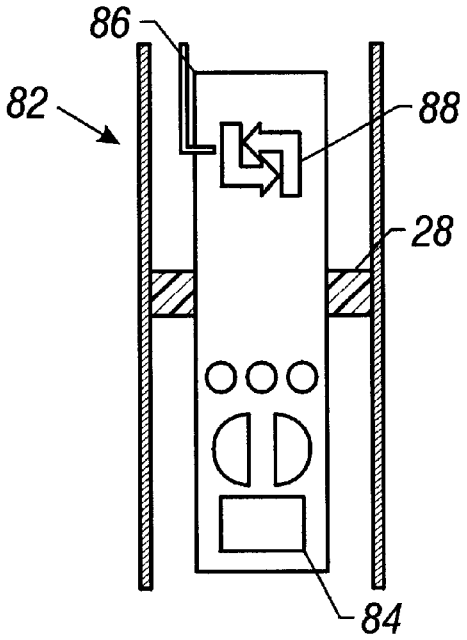
FIG. 6 illustrates another embodiment for operating the valves located below the upper sealing element.

In another embodiment as shown in FIG. 6, tool string 10 includes an acoustic or electromagnetic telemetry system 82 and an interface module 84. Acoustic telemetry system 82 is preferably located above upper sealing element 28 and includes a signal line 86 and an acoustic system module 88. Acoustic system module 88 may correspond to communication component 106, and signal line 86 may correspond to transmission line 108. Signals are sent from the surface through signal line 86 and are received by the acoustic system module 88. Acoustic system module 88 then acoustically transmits command signatures downhole, past the upper sealing element 28, to the acoustic interface module 84. Acoustic interface module 84 interprets the acoustic command signatures and responds by operating the valve, 26, 52, or 100, in the appropriate corresponding manner. In one embodiment, each valve, 26, 52, or 100, has its own independent acoustic interface module. In another embodiment, all of the valves, 26, 52, and 100, are operated by one acoustic interface module.

The sampler apparatus 54 is, as illustrated in the Figures, also located below upper sealing element 28. The sampler apparatus 54 may be operated from above the upper sealing element 28 utilizing the same techniques discussed with respect to the valves, 26, 52, and 100. That is, the sampler apparatus 54 may be operated by use of a hydraulic line exposed to the annulus above the upper sealing element 28, a local telemetry bus and an interface module, a direct control line and solenoids, or an acoustic telemetry system and an acoustic interface module.

Schlumberger's IRIS Dual Valve and IRIS Safety Valve have been identified herein as potential candidates for some of the valves of tool string 10. One of the benefits of using the IRIS Dual and Safety Valves is that they may be activated electrically, by applied pressure, or by pressure pulse telemetry. Thus, with no or few modifications, the IRIS Dual and Safety Valves may be operated by most if not all of the techniques discussed above (a hydraulic line exposed to the annulus above the upper sealing element 28, a local telemetry bus and an interface module, a direct control line and solenoids, or an acoustic telemetry system and an acoustic interface module). In the preferred embodiment, each of the valves, 26, 52, and 100, as well as the sampler apparatus 54 are constructed so that they may be similarly operated by most if not all of the same techniques.

If the wellbore 12 is cased, then the casing 14 must be perforated prior to testing. There are a variety of perforating methods available to perforate the casing 14 adjacent the production zone 16 and the injection zone 18.

In one embodiment, the upper zone 92 is perforated by a wireline conveyed perforating gun run in the wellbore 12 prior to running the tool string 10 downhole. Similarly, in one embodiment, the lower zone 94 is perforated by a wireline conveyed perforating gun run in the wellbore 12 prior to running the tool string 10 downhole.

Figure 7:
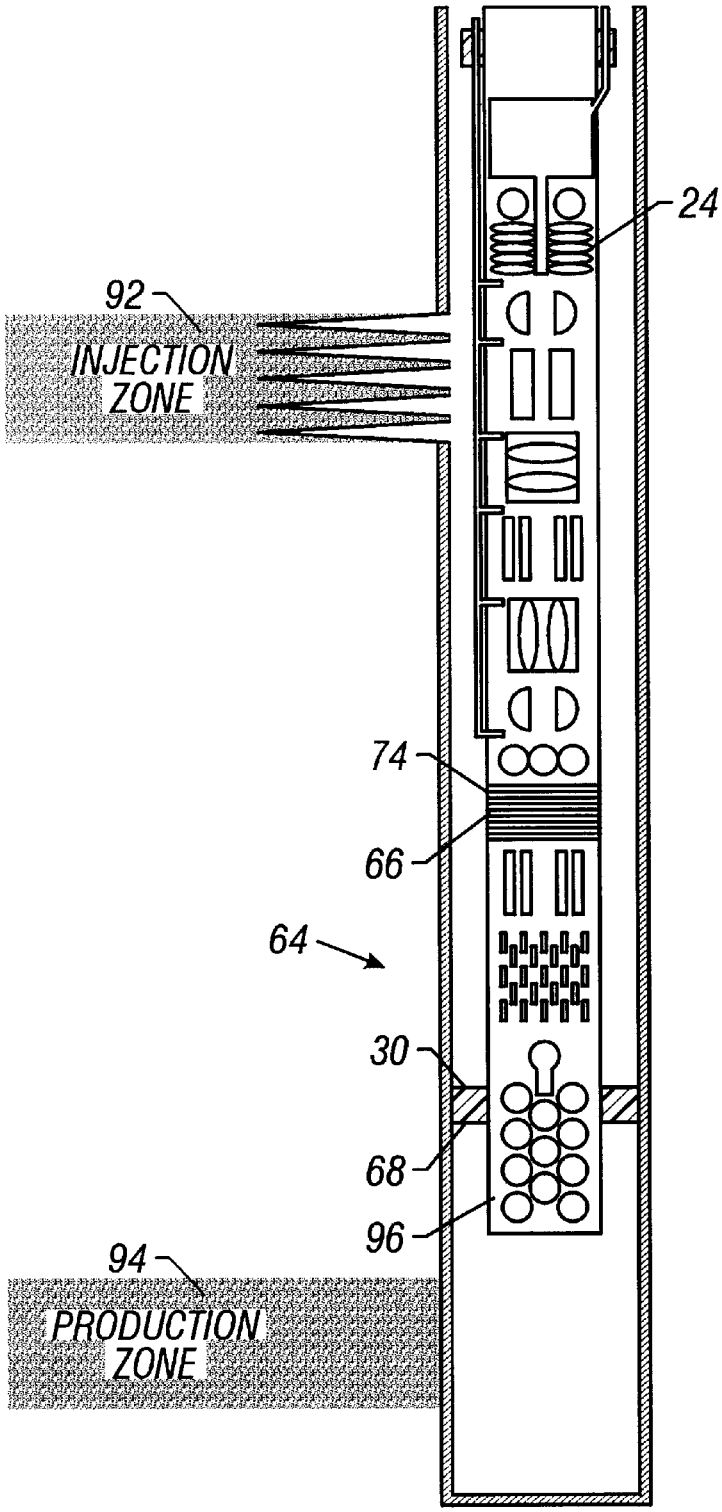
FIG. 7 illustrates one embodiment of the tool string, including a perforating gun to perforate the lower zone.
Figure 8:
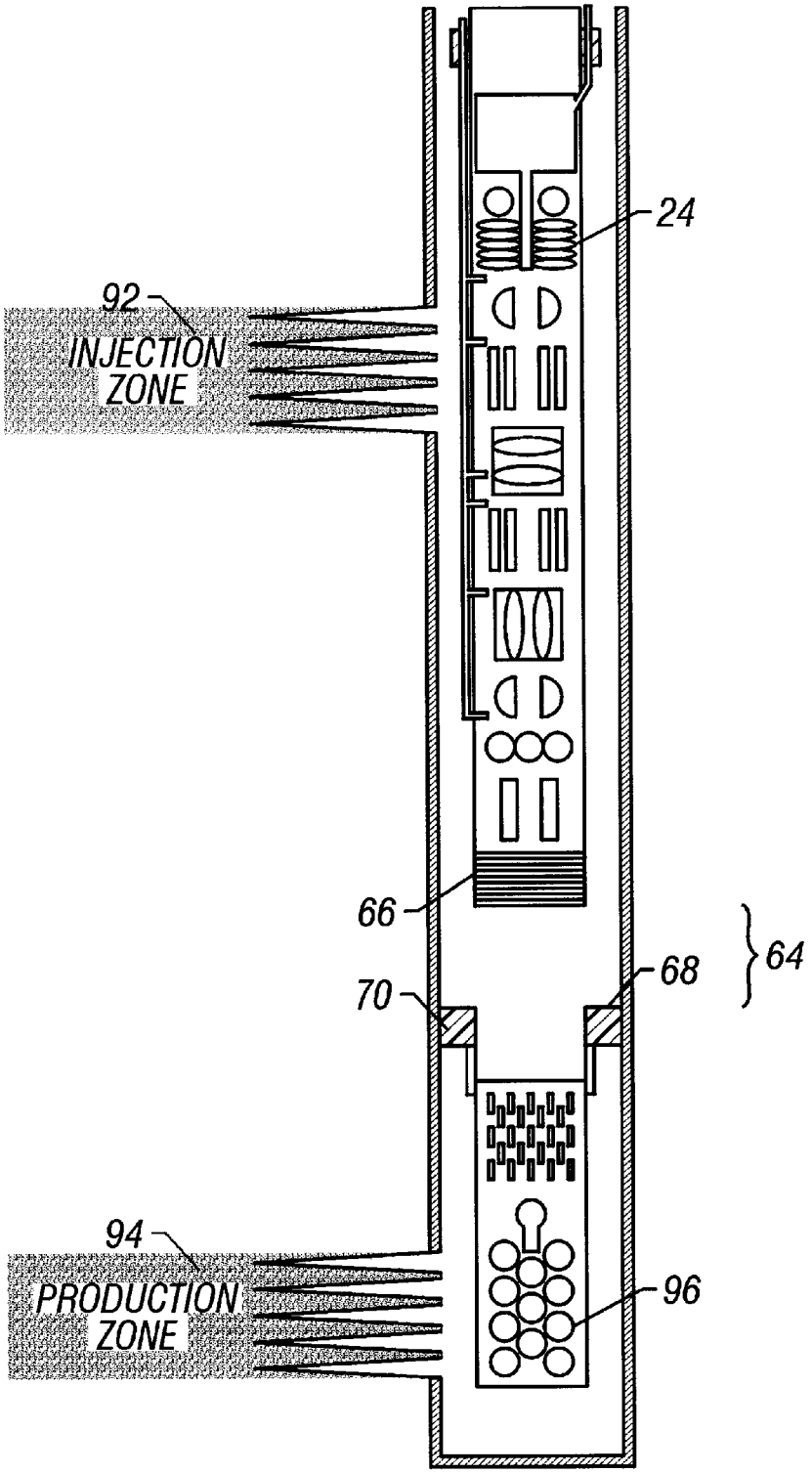
FIG. 8 illustrates another embodiment of the tool string, including a perforating gun to perforate the lower zone.

In the embodiment in which the upper zone 92 is perforated by a wireline conveyed perforating gun, the lower zone 94 can be perforated by a tubing conveyed perforating gun attached to the tool string 10. In one embodiment as shown in FIG. 7, perforating gun 96 is attached to the lower end of tool string 10. Upper zone 92 is already perforated. Tool string 10, with perforating gun 96 thereon, is lowered into the wellbore 12. In the embodiment shown in FIG. 7, the tool string 10 is shown being deployed with the use of a packer stinger assembly 64 in which the stinger portion 66 is being stung into the already set packer body portion 68. It is understood, however, that a packer, such as Schlumberger's High Performance Packer, may also be used, in which case the lower sealing element 30 would be deployed on the tool string 10 together with the upper sealing element 28. Once properly positioned, perforating gun 96 is activated by means known in the art, such as by pressure pulse signals or applied pressure, thereby perforating the lower zone 94. In another embodiment as shown in FIG. 8, perforating gun 96 is attached to the packer body portion 68 of the packer stinger assembly 64. Upper zone 96 is already perforated. Packer body portion 68 and perforating gun 96 are first run into the wellbore 12 and the sealing elements 70 are set. Next, the remainder of the tool string 10 is run in the wellbore 12 and the stinger portion 66 is inserted into the packer body portion 68. Once tool string 10 is properly positioned and set, perforating gun 96 is then activated thereby perforating lower zone 94.

In another embodiment (not shown), perforating gun 96 is attached to an anchor located below the lower sealing elements 30 so that perforating gun 96 is adjacent lower zone 94. Once the tool string 10 is in position and set, perforating gun 95 is activated thereby perforating lower zone 94. In the embodiments in which the perforating gun 96 is attached to the packer body portion 68 or the anchor, the upper zone 96 may also be perforated with guns attached to the tool string 10.

Figure 9:
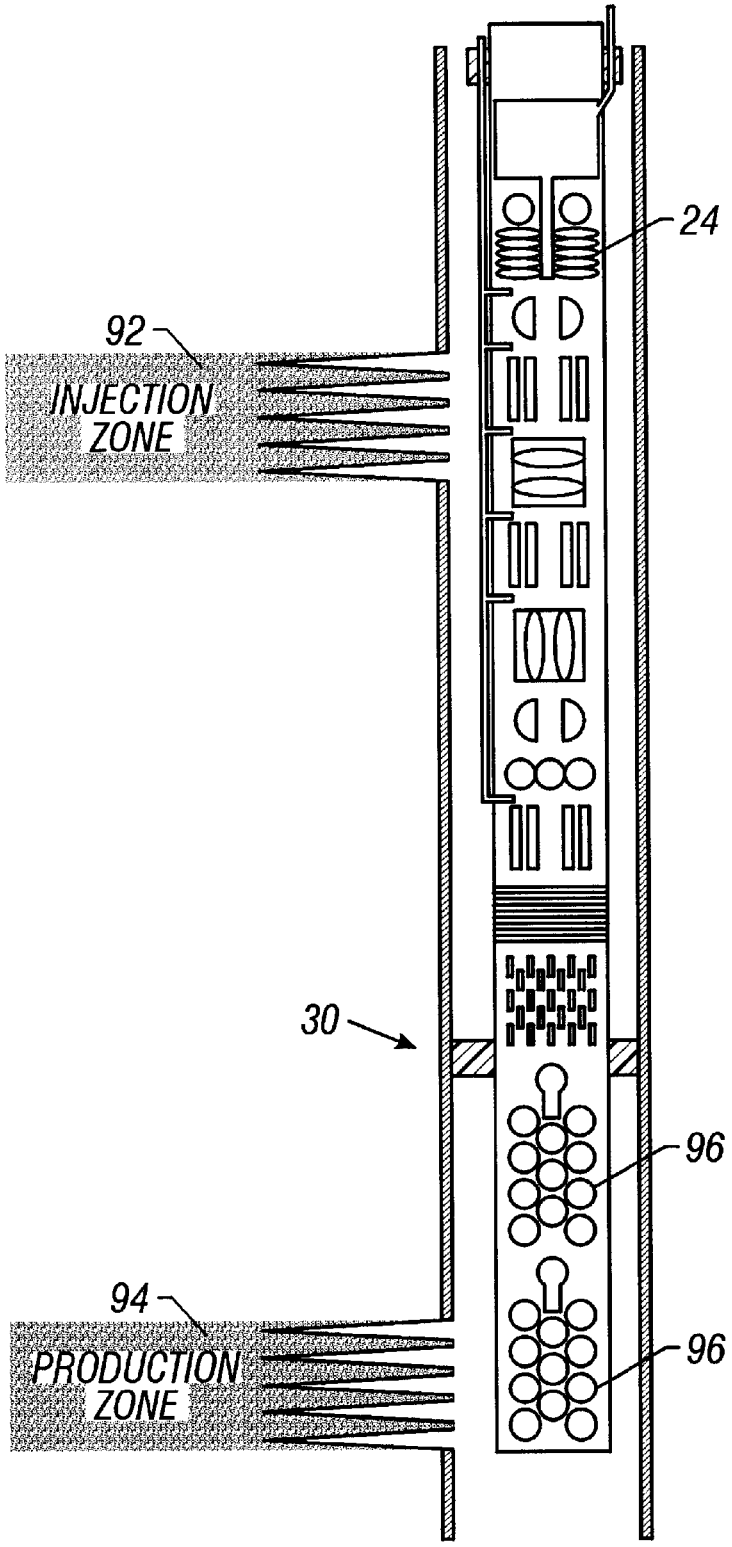
FIG. 9 illustrates an embodiment of the tool string, including two perforating guns, one for perforating the upper zone and the second for perforating the lower zone.

In the embodiment shown in FIG. 9, both the upper zone 92 and the lower zone 94 are perforated using tubing conveyed perforating guns. In this embodiment, two perforating guns 96 are positioned preferably at the lower end of tool string 10. As the tool string 10 is run downhole, one of the perforating guns 96 is used to perforate the upper zone 92. Thereafter, the tool string 10 is continued to be run downhole. Once properly positioned, the second perforating gun 96 is activated thereby perforating the lower zone 94. In the preferred embodiment, the higher of the two perforating guns 96 is used to perforate the lower zone 94.

Figure 10:
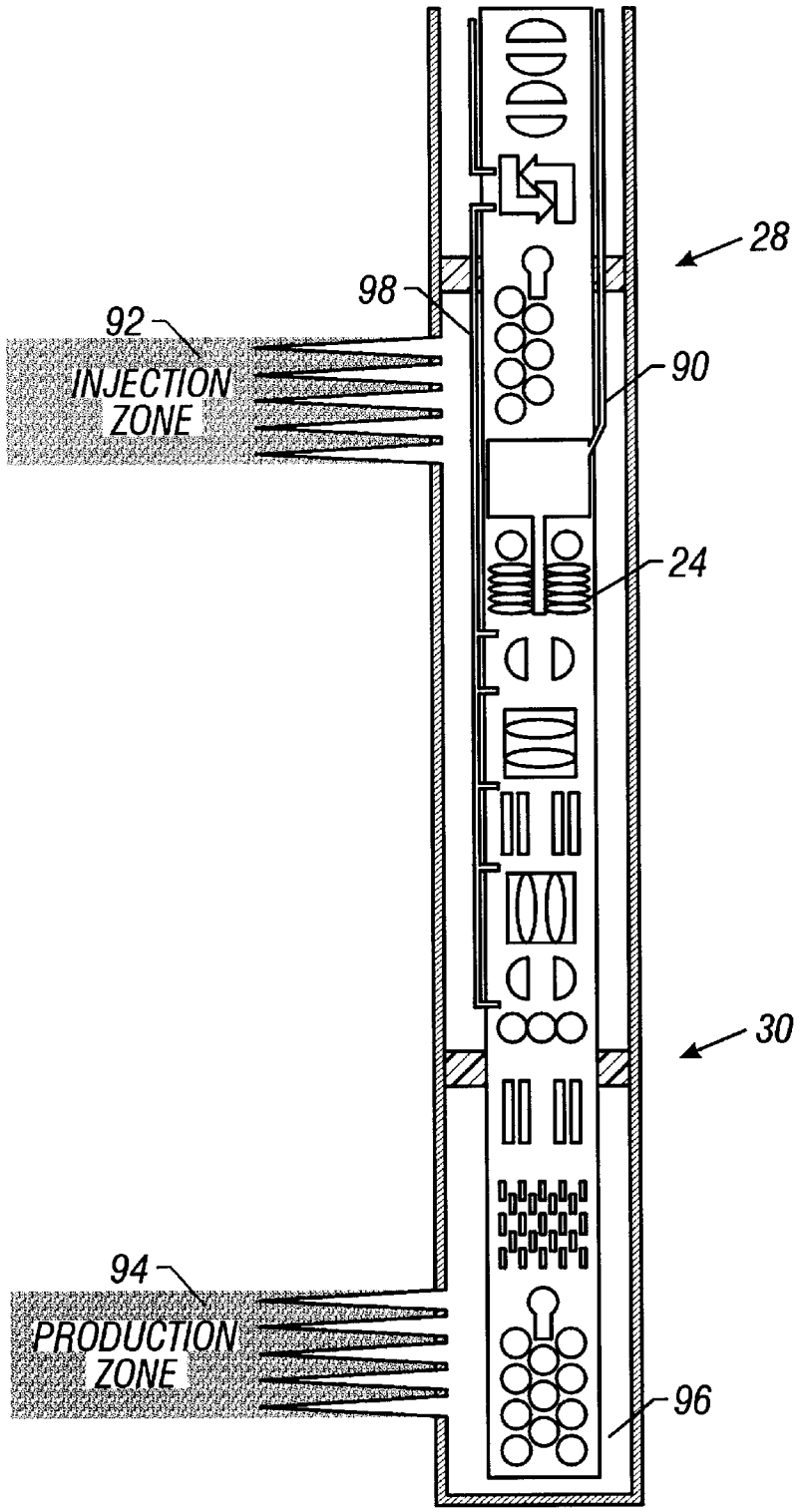
FIG. 10 illustrates an embodiment of the tool string, including an oriented perforating gun for perforating the upper zone and a perforating gun for perforating the lower zone.

In the embodiment shown in FIG. 10, the upper zone 92 and lower zone 94 are also perforated using tubing conveyed perforating guns. In this embodiment, however, one perforating gun 96 is positioned at the lower end of tool string 10 and a second oriented perforating gun 98 is positioned in the tool string 10 so that is adjacent the upper zone 92 once the tool string 10 is in place. Oriented perforating gun 98 is constructed and positioned on tool string 10 so that it does not perforate in the direction of power cable 90, data line 104, or transmission line 108, when fired. Once tool string 10 is properly positioned in wellbore 12 and the upper sealing element 28 and lower sealing element 30 are set, the oriented perforating gun 98 is activated thereby perforating upper zone 92, and the perforating gun 96 is activated thereby perforating lower zone 94.

Preferably, all perforating guns 96 and oriented perforating gun 98 used are low debris guns. When activated, the low debris guns minimize the amount of perforating debris in the wellbore 12 and in the perforations, 17 and 19.

In operation, the tool string 10 is run downhole with the barrier valve mechanism 44 in the closed position, the flow valve 26 in the closed position, the sampling valve 52 in the open position, and the circulating valve 100 in the closed position. It is assumed that the upper zone 92 and the lower zone 94 have already been perforated using one of the techniques described herein, that the tool string 10 is properly positioned in the wellbore 10, and that the upper sealing element 28 and the lower sealing element 30 have been set. It is also assumed that wellbore 12 is already filled with an appropriate kill fluid.

First, a signal is sent from the surface through the data line 104 or transmission line 108 (or hydraulic line not shown) to open the flow valve 26. The pump 24 is also activated by turning the power on through power cable 90. Pump 24 generates a flow of fluid from the production zone 16, through the production zone perforations 17, through the production inlet 20, through the interior of tool string 10, through the injection outlet 22, through the injection zone perforations 19, and into the injection zone 18. As the fluid flows through the interior of tool string 10, the pressure and temperature units 46 record and monitor the pressure and temperature of the fluid, the flow meter 48 records and monitors the flow rate of the fluid, and the fluid identifier 50 records and monitors the oil content of the fluid. The data taken by these instruments, 46, 48, and 50 (and the solid detector and fluid density meter), is preferably available at the surface by way of data line 104 or transmission line 108. In the alternative embodiment, downhole recorders record the data.

After a sufficient amount of time, the appropriate signal is transmitted through data line 104 or transmission line 108 (or hydraulic line not shown) from the surface to close the flow valve 26. Immediately thereafter, the pump 24 is stopped by turning the power off through power cable 90. Closing the fluid path through tool string 10 results in a pressure build up of the fluid in the production zone 16 occurring on the production zone 16 side of the flow valve 26. The build up is recorded and monitored by at least one of the pressure and temperature units 46, which data is available at the surface by way of data line 104 or transmission line 108 (or is being recorded by a downhole recorder).

Once the build up is completed, the appropriate signal is transmitted from the surface through data line 104 or transmission line 108 (or hydraulic line not shown) to once again open the flow valve 26. The pump 24 is then once again activated by turning the power on through power cable 90, which action re-establishes the flow of fluid from production zone 16 to injection zone 18. The characteristics of the fluid are once again recorded and monitored by the relevant tool string 10 instruments and surface equipment, and the reservoir limits or boundaries are thereby evaluated. Additional build up and flow periods may be performed.

During at least the flow periods, the fluid identifier 50 monitors the oil content of the fluid flowing through tool string 10, such readings being preferably available at the surface through data line 104 or transmission line 108. Once the operator determines by way of the fluid identifier readings that the fluid flowing through the interior of the tool string 10 has the appropriate oil content, the flow of the fluid through tool string 10 should be lowered, such as by running pump 24 at a lower rate, as is well-known in the art. During the lower flow period, the sampler apparatus 54 is triggered by the appropriate signal through data line 104 or transmission line 108 (or hydraulic line not shown) and samples of the fluid are taken by the sample chambers. It is noted that the readings taken by the fluid identifier 50 which are preferably available at the surface through data line 104 or transmission line 108 may be used to ensure that the sampler apparatus 54 is triggered at the appropriate time.

Subsequent to triggering the sampler apparatus 54, a signal is sent through the data line 104 or transmission line 108 (or hydraulic line not shown) which closes the sampling valve 52 and the flow valve 26, trapping a substantial volume of dead fluid therebetween. A signal is also sent by way of power cable 90 to stop the pump 24. This type of sampling will be hereinafter referred to as "dead-oil sampling". The area between sampling valve 52 and flow valve 26 comprises a compartment 500 wherein the compartment 500 is at least partially defined by the valves, 52 and 26. The volume of dead-oil or dead fluid within compartment 500 comprises several barrels of fluid, a much larger amount than typically held by the sample chambers of sampler apparatus 54. This volume of dead-oil is then brought back to the surface together with the remainder of the tool string 10. An alternative to the dead-oil sampling technique is to reverse circulate a volume of fluid to the surface while the tool string 10 remains downhole.

The dead-oil sampling technique may also be performed by use of other tool string architectures (not shown) and designs of compartment 500. For instance, instead of comprising the area between two valves, compartment 500 may be at least partially defined by a large compartment chamber or conduit selectively closed by one valve or a large compartment chamber or conduit that is selectively in fluid communication with the interior of the tool string. All of these designs are within the scope of this invention.

It is noted that the amount of dead oil sampled depends on the distance between the two valves, 52 and 26, or the size of the relevant compartment chamber or conduit. Since tool string 10 is modular, the distance between the two valves, 52 and 26, may be modified at the discretion of the operator by adding tubing string or other components therebetween. The size of the compartment chamber or conduit may also be modified by the operator. Thus, since the operator has control over the distance between the two valves, 52 and 26, and over the size of the compartment chamber or conduit, the operator may also control the amount of dead oil sampled using this technique.

In the embodiment including the dead-oil sampling technique, dedicated surface equipment 102 is preferred in order to vent off any trapped gas and safely transfer the dead-oil volume to containers. In addition, in one embodiment, prior to or during venting of the gas, the volume of the gas trapped within the compartment 500 is measured by use of a gas volume measuring device, such as a gauge.

Figure 11:
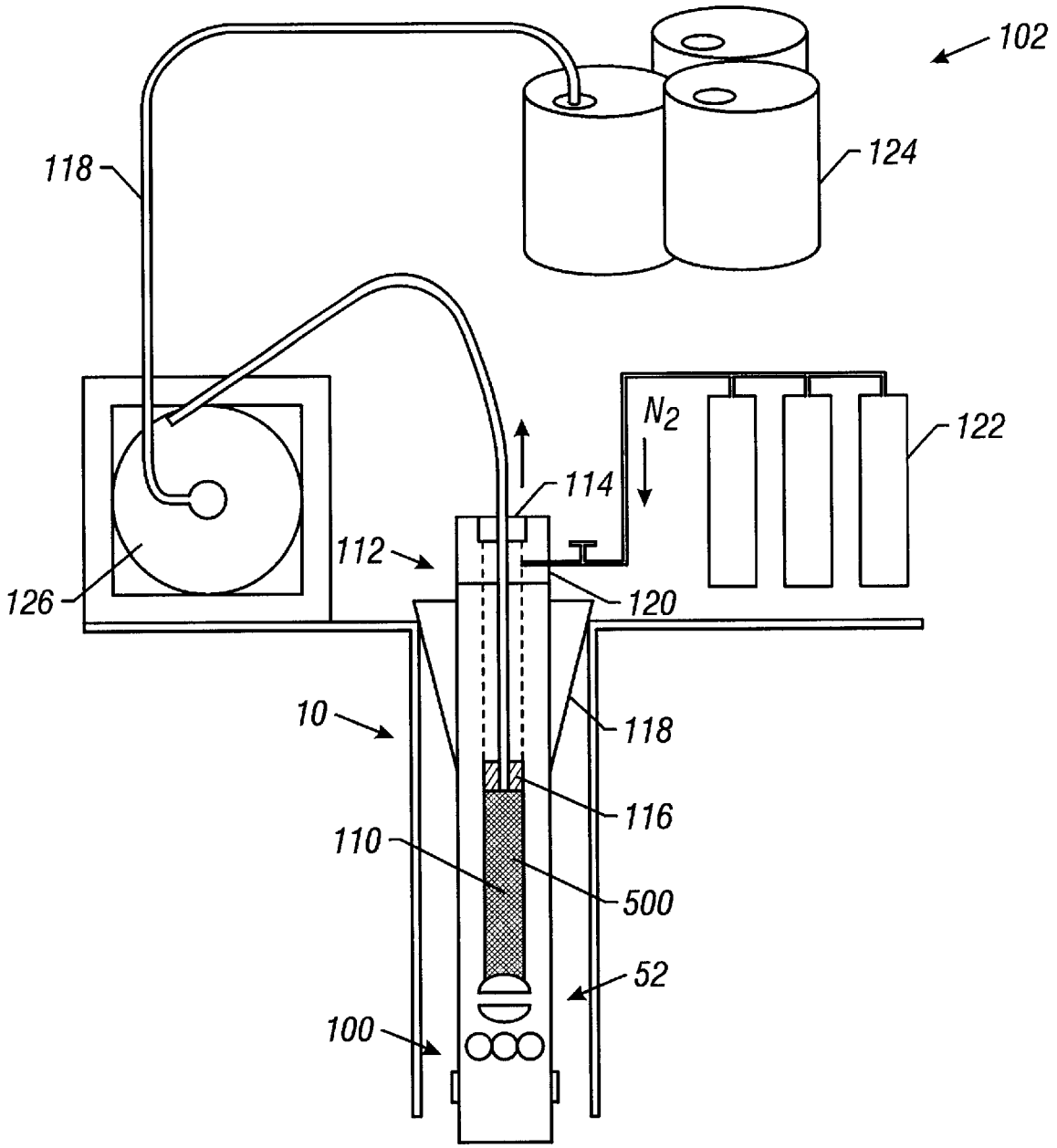
FIG. 11 illustrates a first embodiment of the dedicated surface equipment used to vent off the gas trapped in and to drain the dead-oil volume.
Figure 12:
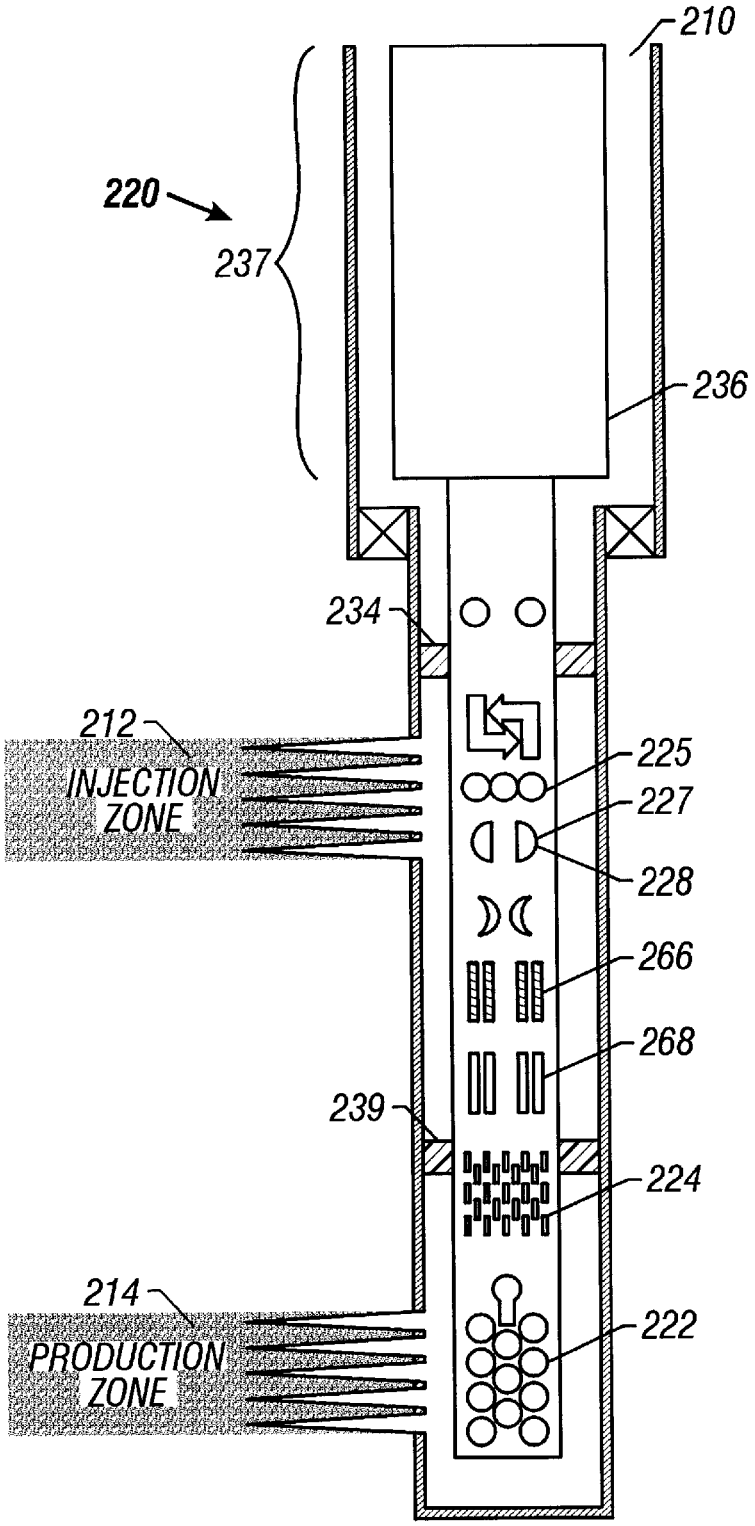
FIG. 12 illustrates an embodiment of the tool string as disclosed in the Parent Application.
Figure 13:
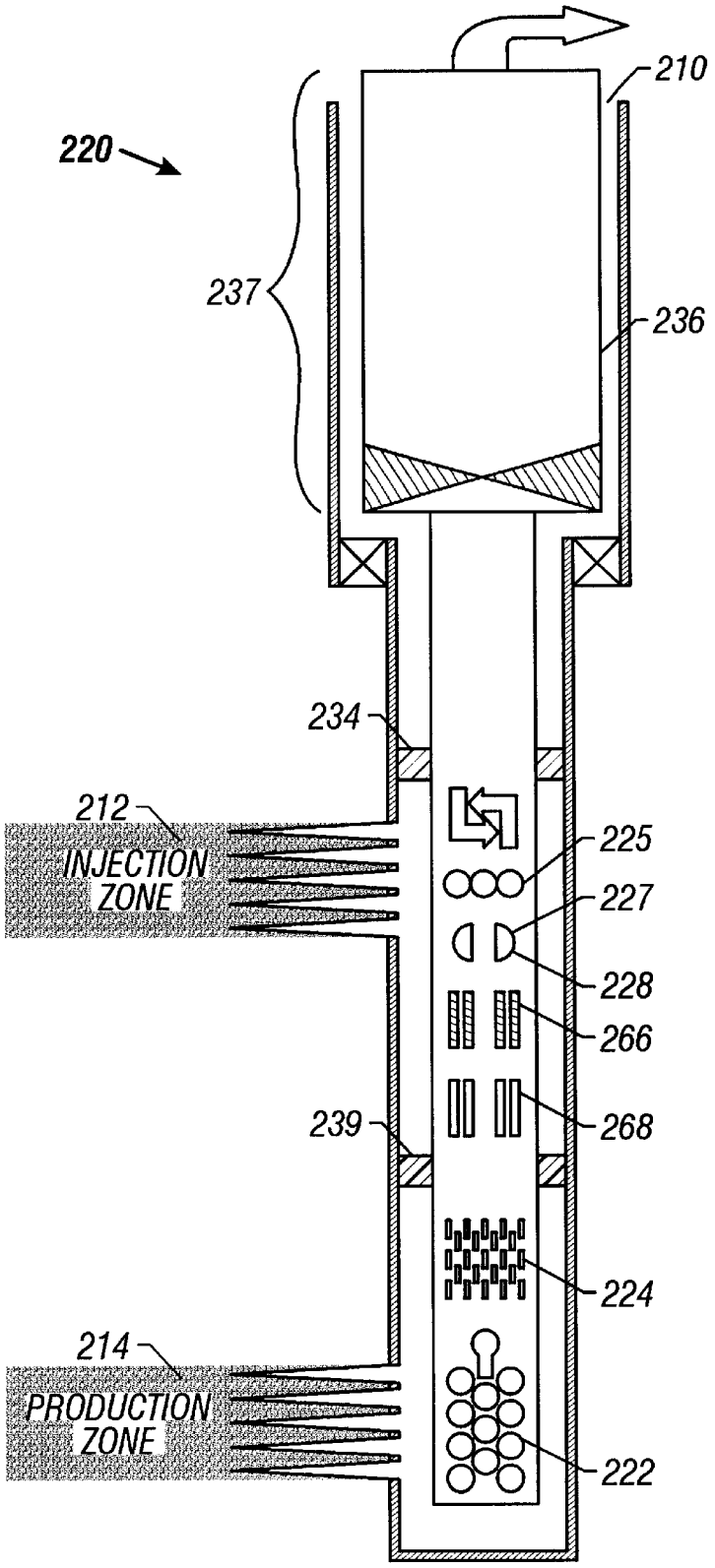
FIG. 13 illustrates another embodiment of the tool string as disclosed in the Parent Application.
Figure 14:
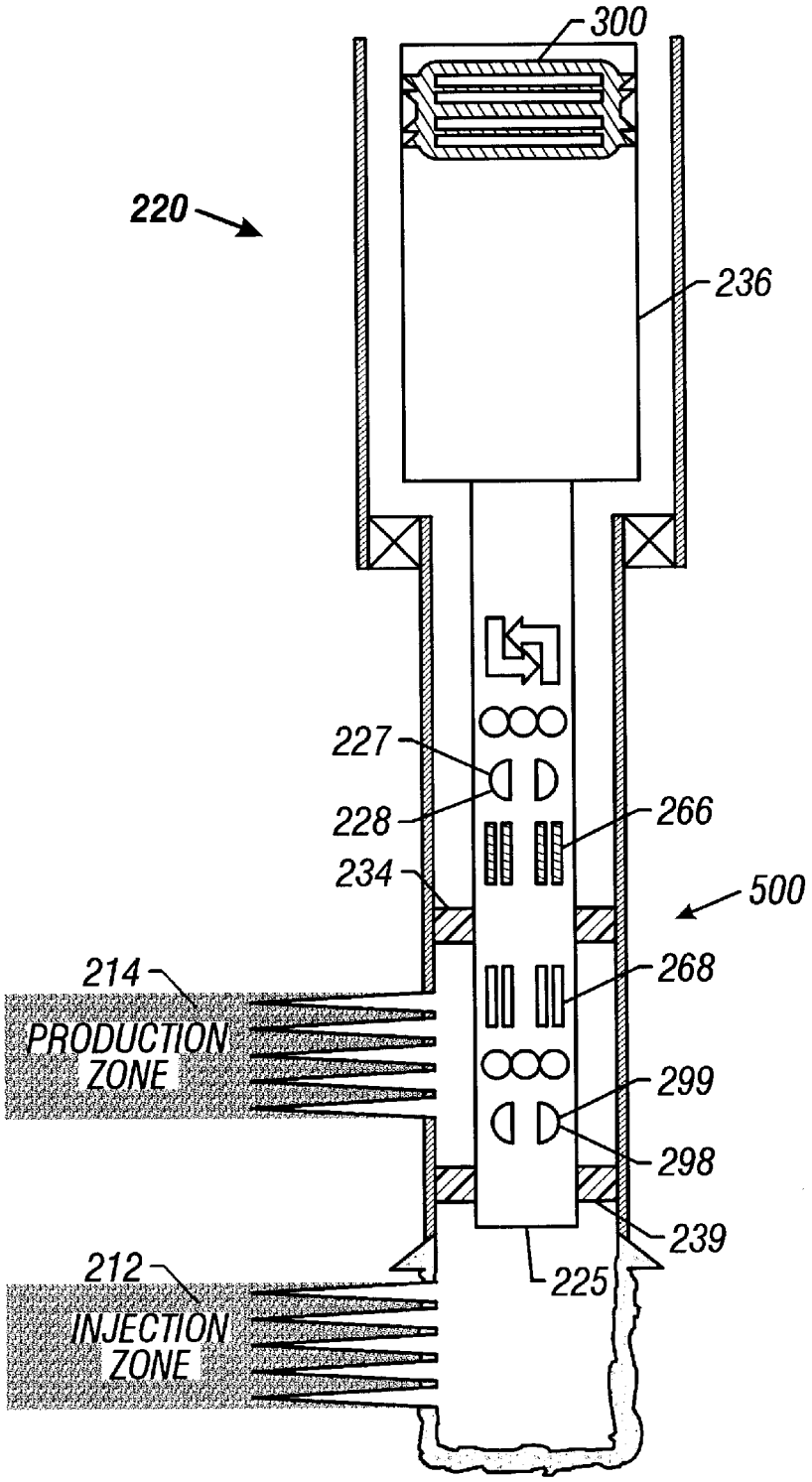
FIG. 14 illustrates another embodiment of the tool string as disclosed in the Parent Application.
Figure 15:
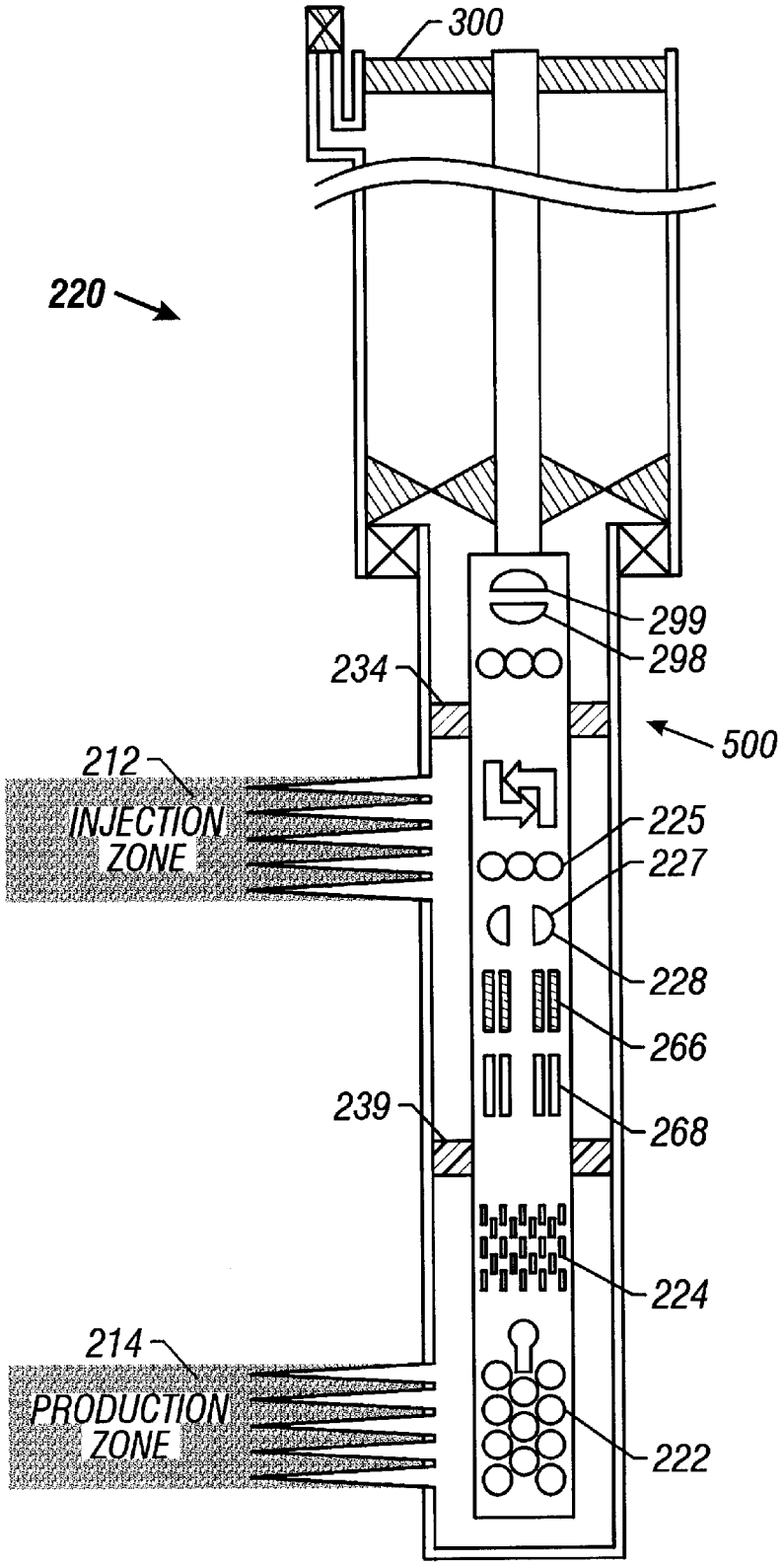
FIG. 15 illustrates another embodiment of the tool string as disclosed in the Parent Application.
Figure 16:
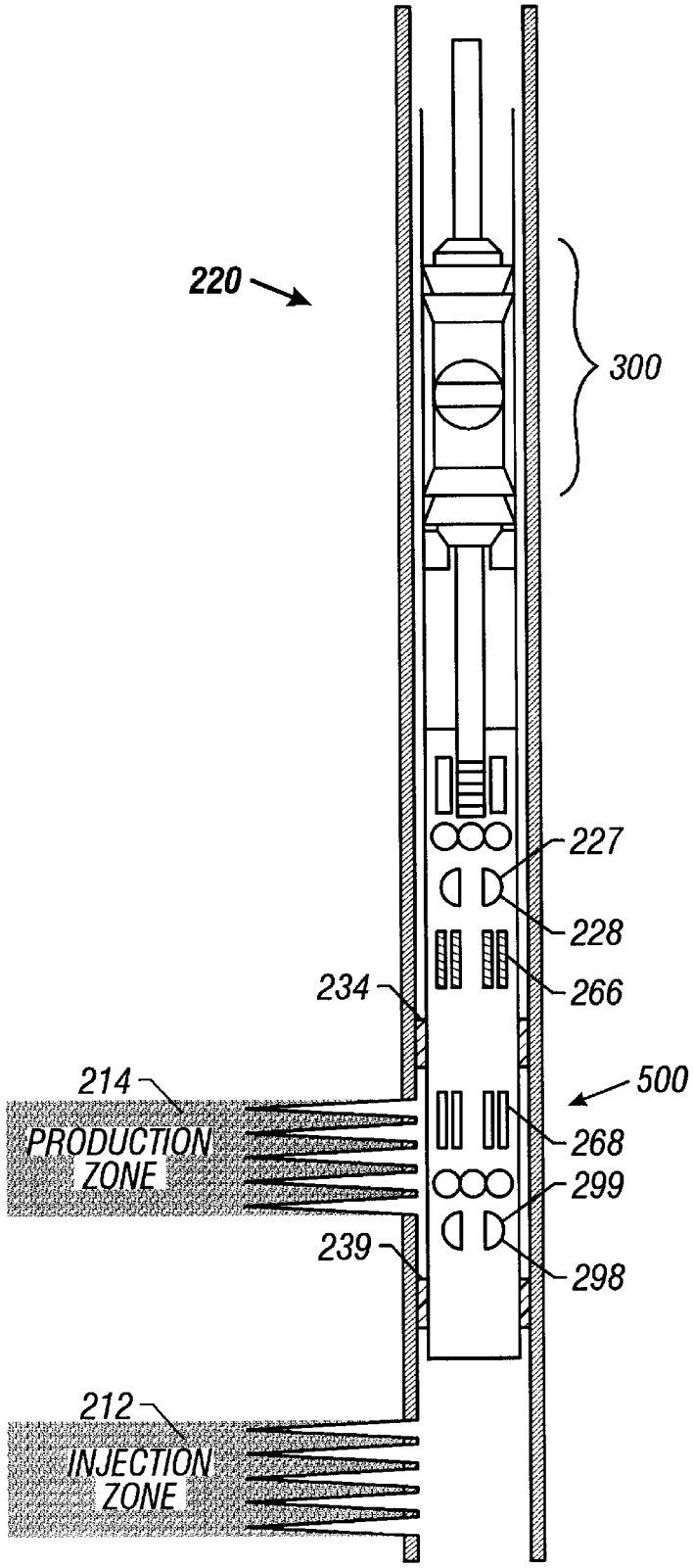
FIG. 16 illustrates another embodiment of the tool string as disclosed in the Parent Application.
Figure 17:
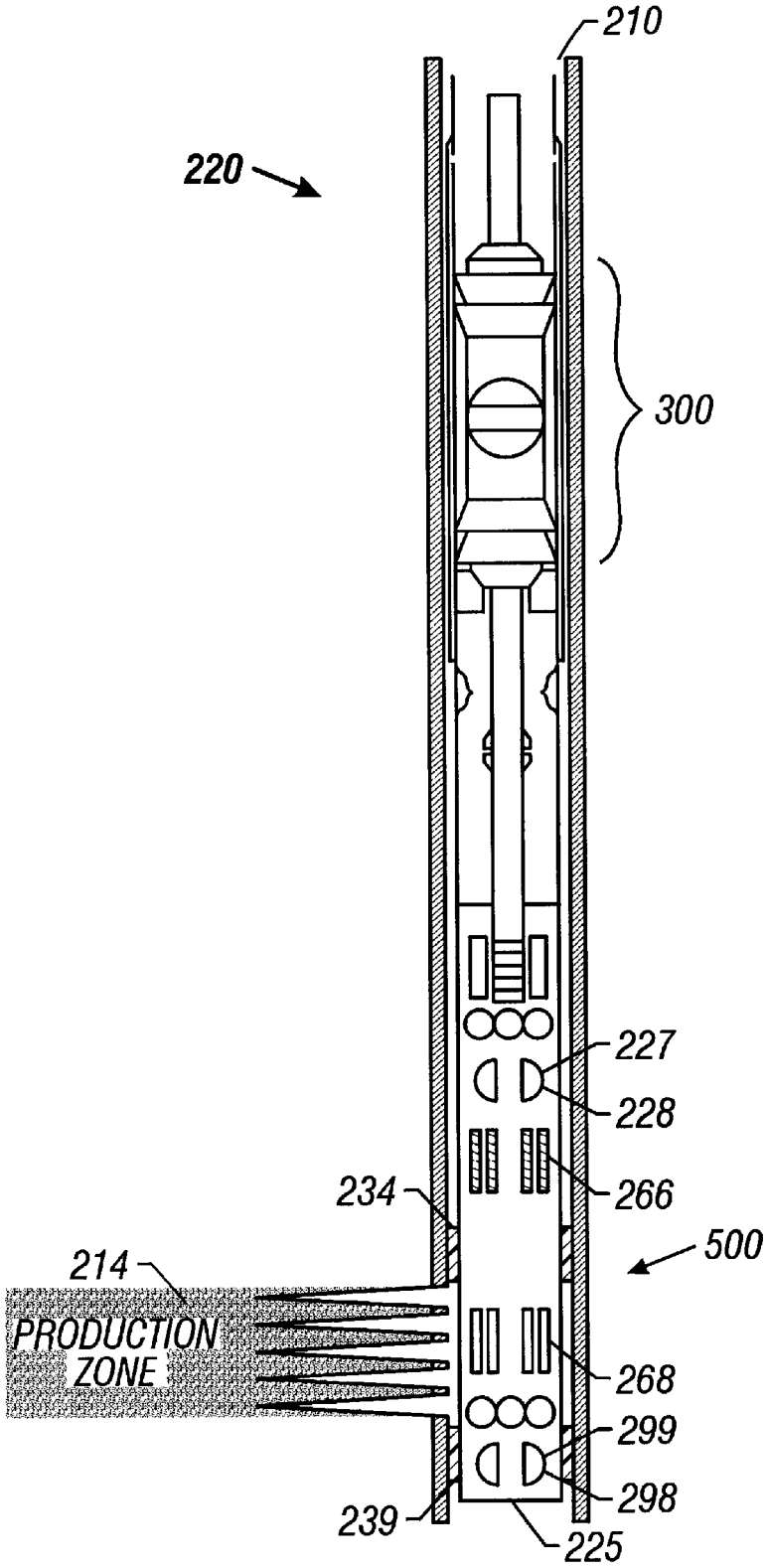
FIG. 17 illustrates another embodiment of the tool string as disclosed in the Parent Application.

FIG. 11 illustrates one embodiment of the dedicated surface equipment 102. As the tool string 10 is brought back to the surface, the modules of the tool string 10 are disassembled. When the flow valve 26 is at surface, the operator should attach a vent valve (not shown) above the flow valve 26 and should open the flow valve 26. By opening the flow valve 26, the gas trapped below the flow valve 26 passes through the flow valve 26 and out of the assembly through the vent valve. Once the trapped gas is vented, the vent valve and the flow valve 26 may be removed from the assembly, leaving the dead-oil volume 110 disposed in now partially open compartment 500.

Next, a valve assembly 112 is attached to the assembly. The valve assembly 112 includes a stuffing box 114, a piston 116, and a conduit 118. Conduit 118 is sealingly disposed through stuffing box 114 and piston 116. In addition, conduit 118 may slide within stuffing box 114, and piston 116 may slide within the interior of the remaining tool string 10. Valve assembly 112 also includes a passage 120 in fluid communication with a pressure source 122. Passage 120 is preferably located so that it is also in fluid communication with the interior of the valve assembly 112 intermediate the stuffing box 114 and the piston 116.

The operator should first activate the pressure source 122, which may be nitrogen gas, so that the pressurized fluid flows through passage 120 and into the valve assembly 112. The pressurized fluid acts against the piston 116, making it slide toward the dead fluid or downwardly within the compartment 500. As the piston 116 slides, it compresses the dead-oil volume 110 disposed within compartment 500. As the dead-oil volume 110 is compressed, the dead-oil volume 110 is forced into and through conduit 118. Conduit 118 transmits the dead-oil volume 110 to appropriate containers 124. It is noted that a reel 126 may be used in order to retrieve or extend conduit 118.

When the piston 116 is adjacent the sampling valve 52, the pressurized fluid is bled off. The conduit 118 is then retrieved and is unlatched from the piston 116 and stuffing box 114. Conduit 118 may include a check valve (not shown) to prevent any fluid from flowing out of its open end. The remainder of the tool string 10, including valve assembly 112, is then disassembled.

Figure 18:
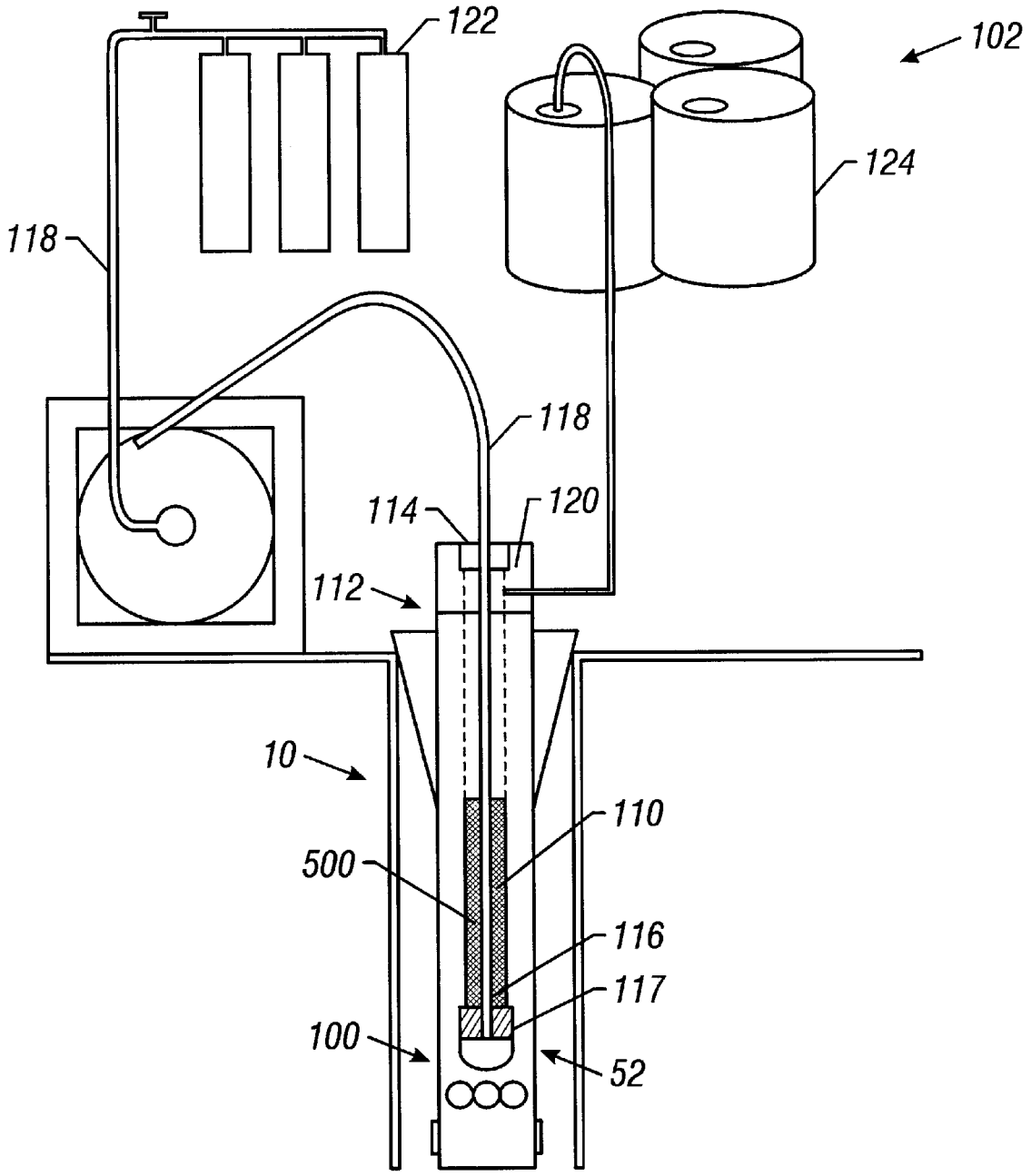
FIG. 18 illustrates a second embodiment of the dedicated surface equipment used to vent off the gas trapped in and to drain the dead-oil volume.

In another embodiment of the dedicated surface equipment 102 (as shown in FIG. 18), after the trapped gas is vented and the vent valve and flow valve 26 are removed from the assembly, the conduit 118 and piston 116 are moved into and within compartment 500 so that a majority of the dead fluid is intermediate the piston 116 and the passage 120. Preferably, the piston 116 is moved so that its lower end is adjacent the lower end of compartment 500. In this embodiment, piston 116 includes fluid communication ports 117 therethrough that can be selectively closed. The piston 116 and conduit 118 are moved towards the lower end of compartment 500 with the ports 117 of the piston 116 in the open position. Once the piston 116 and conduit 118 are next to the lower end of compartment 500, the fluid communication ports 117 of the piston 116 are closed. In this embodiment, pressure source 122 is connected to the conduit 118 so that pressurized fluid is injected through conduit 118. Also in this embodiment, the containers 124 are in fluid communication with the passage 120. When pressurized fluid is injected through conduit 118, the pressure flowing out of the open end of the conduit 118 makes the piston 116 (now with closed fluid communication ports 117) move upwards. As the piston 116 moves upwards, the dead oil volume is forced towards and through the passage 120, which is in fluid communication with the containers 124. The dead oil volume is thus passed through the passage 120 into the containers 124. Lastly, the pressurized fluid is vented/removed, and the valve assembly 112 is disassembled.

Figure 19:
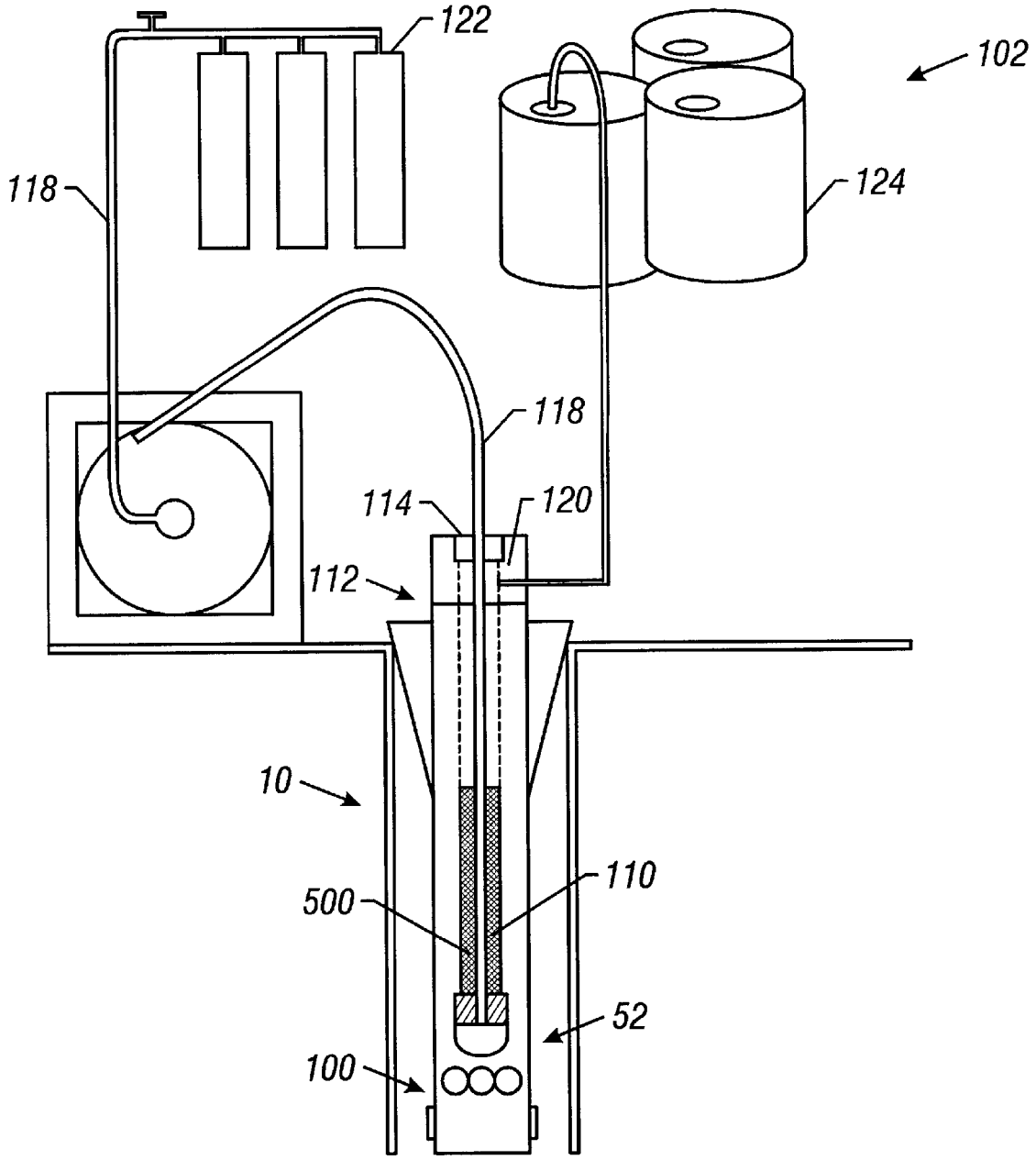
FIG. 19 illustrates a third embodiment of the dedicated surface equipment used to vent off the gas trapped in and to drain the dead-oil volume.

In another embodiment of the dedicated surface equipment 102 (as shown in FIG. 19), after the trapped gas is vented and the vent valve and flow valve 26 are removed from the assembly, the conduit 118 is moved into and within compartment 500 so that a majority of the fluid is intermediate the open end of the conduit 118 and the passage 120. Preferably, the conduit 118 is moved within compartment 500 so that its open end is adjacent the lower end of compartment 500. This embodiment is very similar to that of FIG. 18. However, in contrast to the embodiment shown in FIG. 18, this embodiment does not include a piston 116. Instead, it includes only conduit 118 movably disposed within compartment 500. Once the conduit 118 is properly positioned, the pressure source 122 is activated so that pressurized fluid is injected through conduit 118. In this embodiment, the pressurized fluid contained in pressure source 122 and injected through conduit 118 is preferably a pressurized fluid that is denser than the dead fluid found in compartment 500 (so that the pressurized fluid does not tend to rise through the dead fluid). Thus, as this pressurized fluid is injected through conduit 118, the increasing volume of pressurized fluid forces the dead fluid towards and through the passage 120, which is in fluid communication with the containers 124. The pressurized fluid is then vented/removed, and the valve assembly 112 is disassembled.

Figure 20:
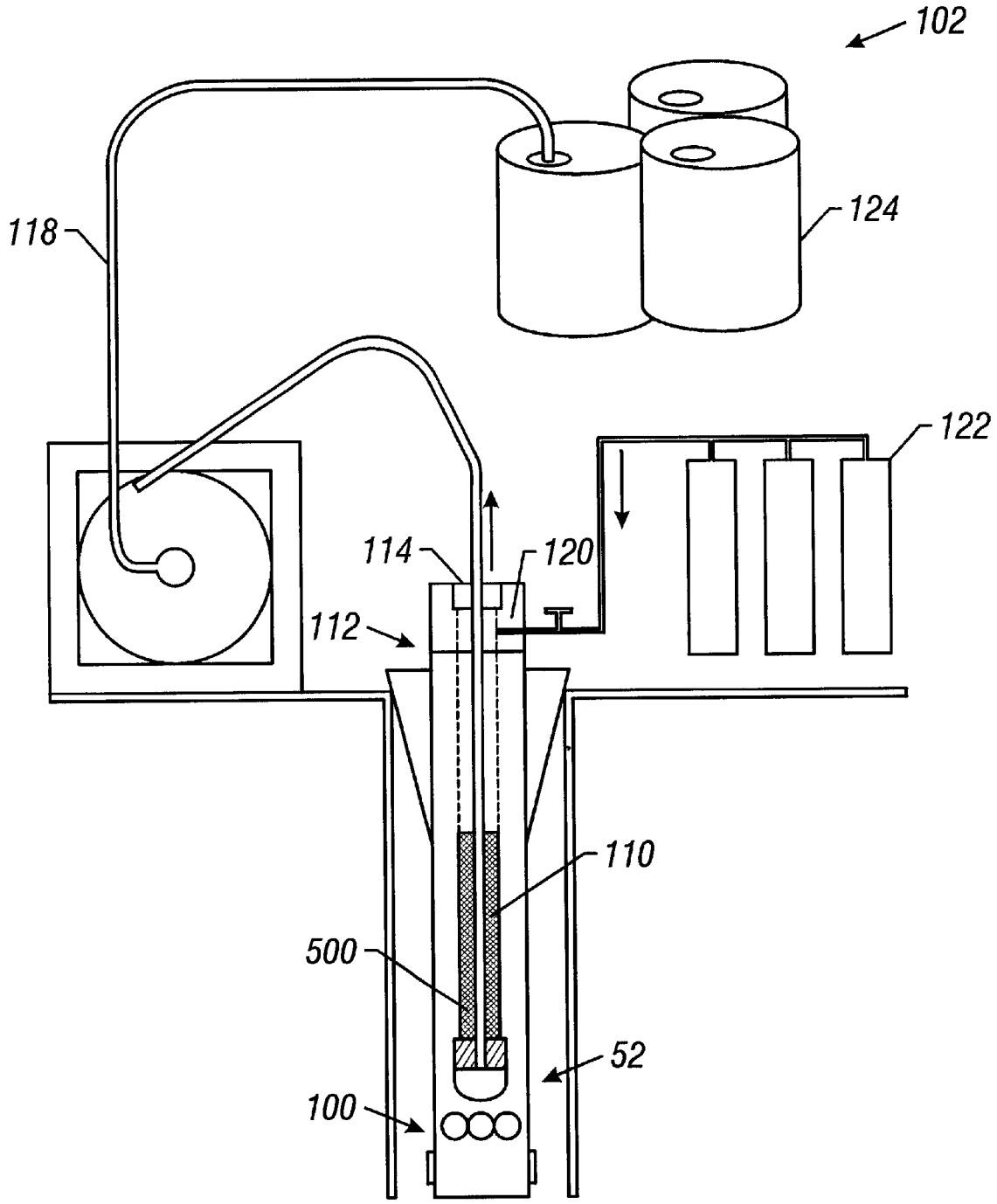
FIG. 20 illustrates a fourth embodiment of the dedicated surface equipment used to vent off the gas trapped in and to drain the dead-oil volume.

Another embodiment of the dedicated surface equipment 102 (as shown in FIG. 20) is similar to the embodiment of FIG. 11, such that the conduit 118 is connected to the container 124 and the passage 120 is connected to the pressure source 122. The embodiment of FIG. 20, however, does not include a piston 116. The conduit 118 is moved into and within compartment 500 so that a majority of the fluid is intermediate the open end of the conduit 118 and the passage 120. Preferably, the conduit 118 is moved so that its open end is adjacent the lower end of compartment 500. Once the conduit 118 is properly positioned, the pressure source 122 is activated so that pressurized fluid is injected through passage 120. As this pressurized fluid is injected through the passage 120, it compresses the dead fluid and forces it into and through the conduit 118, which is in fluid communication with containers 124. The pressurized fluid is then vented/removed, and the valve assembly 112 is disassembled.

Figure 21:
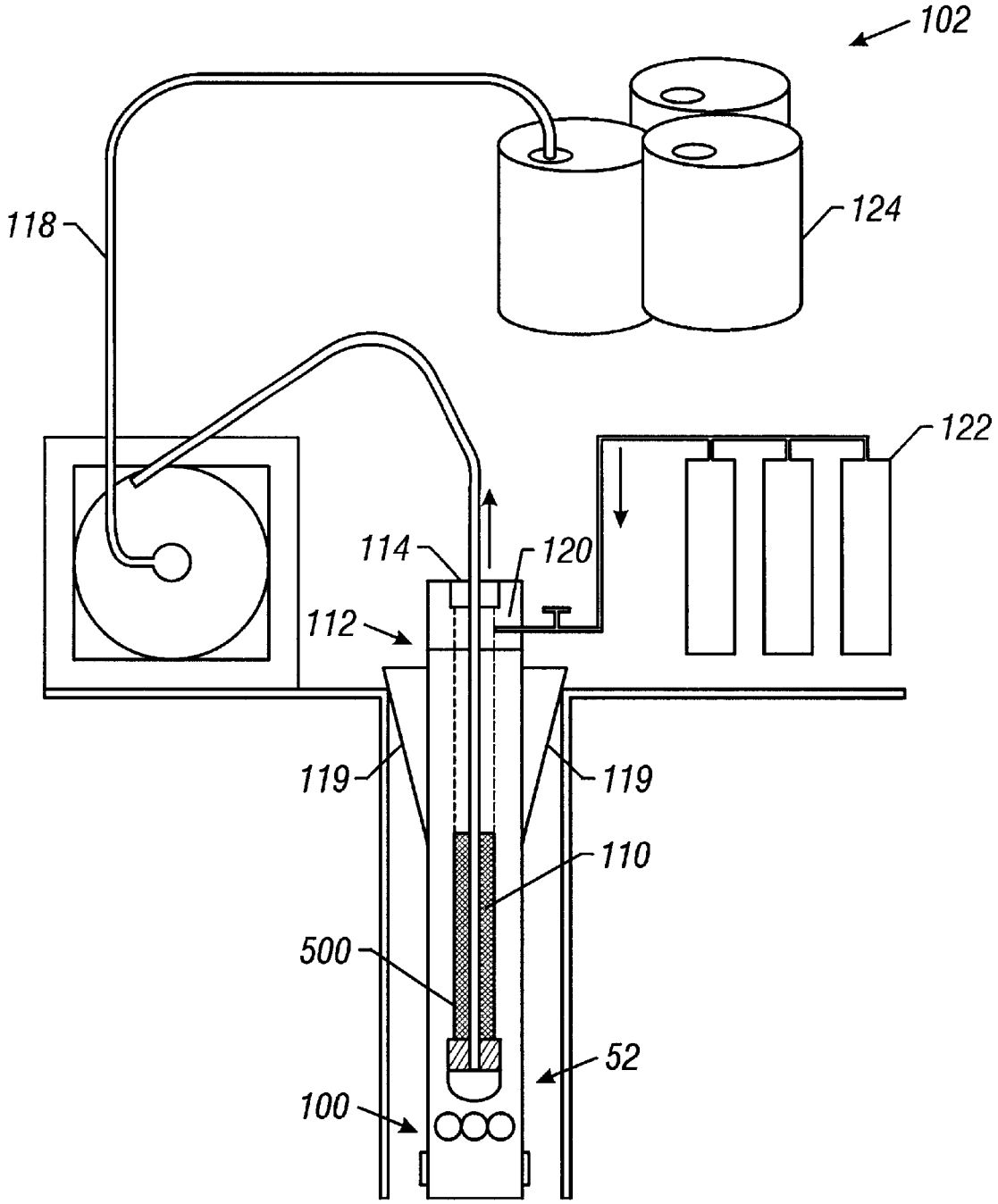
FIG. 21 illustrates a fifth embodiment of the dedicated surface equipment used to vent off the gas trapped in and to drain the dead-oil volume.

In another embodiment as shown in FIG. 21, the dedicated surface equipment 102 includes the conduit 118 and the piston 116, with the conduit 118 connected to the container 124 and the passage 120 connected to the pressure source 122. In this embodiment, however, piston 116 is slidingly disposed on conduit 118, with conduit 118 located within compartment 500 so that a majority of the fluid is intermediate the open end of the conduit 118 and the piston 116. Piston 116 may include at least one seal 119 to slidingly seal against the compartment 500. Preferably, the conduit 118 is moved within compartment 500 so that its open end is adjacent the lower end of the compartment 500. Once the conduit 118 is properly positioned, the pressure source 122 is activated so that pressurized fluid is injected through passage 120. As this pressurized fluid is injected through the passage 120, it forces the piston 116 so slide on conduit 118 towards the dead fluid thereby compressing the dead fluid. The compression of the dead fluid, in turn, causes the dead fluid to flow into and through the conduit 118, which is in fluid communication with containers 124. It is noted that during the sliding movement of piston 116, conduit 118 preferably moves only a small amount, if at all. The pressurized fluid is then vented/removed, and the valve assembly 112 is disassembled.

As previously disclosed, the wellbore 12, prior to the insertion of tool string 10, is filled with kill fluid. Before removing tool string 10 from the wellbore 12 but after the completion of the test, the operator may choose to condition the wellbore fluids and to remove the formation fluids that remain in the wellbore 12 by injecting them back into one of the zones, 92 and 94. First, the barrier valve mechanism 44 is opened and kill fluid is forced therethrough. In the embodiment of FIG. 1, the kill fluid flows through the ports 128 and into the injection zone 18 through the injection zone perforations 19. Ports 128, in one embodiment, may also be a part of a sleeve valve or other type of valve. Note that flow valve 26 is closed at this point prohibiting kill fluid from flowing downwardly through the interior of tool string 10 where the dead-oil volume is contained. It is also noted that kill fluid would likely already be present intermediate the injection zone 18 and the lower sealing element 30. In the embodiment of FIG. 2, the kill fluid flows through the production inlet 20 and into the production zone 16 through the production zone perforations 17. Note that flow valve 26 is closed at this point prohibiting kill fluid from flowing downwardly through the interior of tool string 10. It is also noted that kill fluid would likely already be present intermediate the production zone 16 and the lower sealing element 30.

The next step in the operation is to release the upper sealing element 28 and observe the wellbore 12 to ensure its stability. If the wellbore 12 remains stable, then the lower sealing element 30 may be released and the wellbore 12 should once again be observed. If the wellbore 12 remains stable, then the tool string 10 can then be safely removed from the wellbore 12. It is noted that before or after unsetting the upper and lower sealing elements, 28 and 30, mud can be circulated through the circulation valve of the barrier valve mechanism 44 (in the relevant embodiment) or through an additional circulation valve located above the barrier valve mechanism 44.

FIGS. 12–17 comprise several illustrations taken from this application's Parent Application, which was filed on Feb. 25, 2000, is entitled "Method and Apparatus for Testing a Well", includes Bjorn Langseth, Christopher W. Spiers, Mark Vella, and Dinesh R. Patel as inventors, and is assigned to the Assignee hereto (such application referred to as "Parent Application"). The Parent Application claims priority from U.S. Provisional Application No. 60/130,589 filed on Apr. 22, 1999.

A variety of devices and methods described herein may also be utilized and accomplished using the invention disclosed in the Parent Application. The specification of the Parent Application is hereby incorporated by reference.

Briefly, the invention disclosed in the Parent Application includes a tool string 220 disposed in a wellbore 210, which may include a production zone 214 and an injection zone 212. Tool string 220 may include an enlarged tubing 236 having an increased diameter which forms part of a relatively large volume chamber 237 into which well fluids may flow during closed-chamber testing. Tool string 220 may also include an isolation device 300.

Tool string 220 may include upper and lower sealing elements, 234 and 239, to seal tool string 220 to the wellbore 210 in order to isolate the production and storage zones, 214 and 212, as well as the upper wellbore section above the upper packer 234. Tool string 220 may also include one or more perforating guns 222 attached to the lower end of the tool string 220 to create perforations in the production zone 214 and/or the injection zone 212. Tools string 220 may include one perforating gun (not shown) located higher up on tool string 220 to perforate the higher of the zones, 212 and 214, and a perforating gun 222 located lower down on tool string 220 to perforate the lower of the zones, 212 and 214. The higher up of the perforating guns may comprise an oriented perforating gun so as to not disturb any cables or lines passing from above it. The other perforating methods mentioned in this application may also be utilized in the Parent Application. In addition, tool string 220 includes a production inlet 224 that may comprise a slotted pipe sized to prevent larger debris from being produced into the tool string 220. Alternatively, production inlet 224 may comprise a prepacked screen used to filter our the debris. Tool string 220 also includes an injection outlet 225.

Tool string 220 may also include a sampler apparatus 268 having sampler chambers to collect fluid samples from the production zone 214. In addition, tool string 220 may include at least one pressure and temperature unit 266, each unit 266 including at least one and preferably a plurality of pressure and temperature sensors, for recording and monitoring the pressure and temperature of the fluid flowing through the interior of tool string 220.

Tool string 220 may also include a flow valve 227 to control the flow through the interior of tool string 220. Flow valve 227 is preferably a ball valve 228 that is preferably a component of a Schlumberger IRIS Dual Valve. In some embodiments (FIGS. 14, 15, 16, and 17), tool string 220 also includes a second flow valve 299, preferably a ball valve 298, that controls the flow through the interior of tool string 220. The dead-oil sampling technique described herein may be utilized with the invention disclosed in the Parent Application by trapping the volume of fluid between the ball valves 228 and 298 (or any other relevant valves), the ball valves 228 and 229 at least partially defining compartment 500. As in this invention, the dead-oil sampling technique can be used with the invention disclosed in the Parent Application after the flow and build up periods are completed. In the invention disclosed in the Parent Application, the dead-oil sampling technique may also be performed by use of other tool string architectures and compartment 500 designs, such as a large compartment chamber or conduit (ie., enlarged tubing 36 or large volume chamber 37) selectively closed by one valve or a large compartment chamber or conduit that is selectively in fluid communication with the interior of the tool string.

Moreover, as specified in the specification of the Parent Applications, a variety of other valves, sensors (including flow meters, fluid identifiers, fluid density meters, solids detectors, $H_2S$ detectors, $CO_2$ detectors, and water cut meters), and recorders may be included in tool string 220. In addition, some of these valves, sensors, and recorders are included in tool string 220 below upper sealing element 234. Like in the invention disclosed herein, the valves, sensors, and equipment located below upper sealing means 234, including sampler apparatus 268, pressure and temperature unit 266, flow valve 227, and flow valve 299, may be operated by use of a hydraulic line exposed to the annulus above the upper sealing element 234, a local telemetry bus and an interface module, a direct control line and solenoids, or an acoustic telemetry system and an acoustic interface module. Moreover, a data line similar to data line 104 of the invention described herein, may be used to transmit the readings of the downhole equipment to the surface. To accommodate such functions, upper sealing element 234 preferably comprises a multi-port packer (not shown) including secondary ports. In one embodiment, lower sealing element 239 comprises a packer stinger assembly.

The embodiments of this application as well as the embodiments of the Parent Application have been described as enabling the production of fluid from a first or production zone to a second or injection zone. However, the tool strings 10 or 220 may also be used to produce and inject fluids from and into the same formation. The tool string 10 of this application can achieve this as long as the perforations 19 of upper zone 92 and the perforations 17 of lower zone 94 provide communication to the same formation. Similarly, the tool string 220 of the Parent Application can achieve this if the production and injection zones are part of the same formation. In addition, the tool string 220 of the Parent Application can achieve this by including only the production zone 214 (not an additional injection zone), flowing from the production zone 214 into the chamber 237, and injecting the fluid from the chamber 237 back into the production zone 214.

Moreover, the tool string 10 of this application and the tool string 220 of the Parent Application may be used to produce fluid from a multilateral or other bore (instead of a production zone) and/or to inject fluid into a multilateral or other bore (instead of a production zone). Such a use enables the testing of the fluid flowing through the relevant multilaterals or other bores.

In addition, the tool string 10 of this application and the tool string 220 of the Parent Application can be easily adapted to support two or more production zones and or two or more injection zones. Such adaptation may include the incorporation of a production inlet for each production zone, an injection outlet for each injection zone, and/or valves to control the flow to and from the zones.

The tool string 10 of this application and the tool string 220 of the Parent Application can also be used to test both the production zone and the injection zone. The tool string 220 can be adapted to include the relevant sensors/gauges/meters adjacent the injection zone and the production zone so that both zones are monitored, particularly when chamber 237 is full of fluid from the production zone. Likewise, the tool string 10 can be adapted to include the relevant sensors/gauges/meters adjacent the injection zone and the production zone so that both zones are monitored, particularly during the build up periods of the test cycle.

Figure 22:
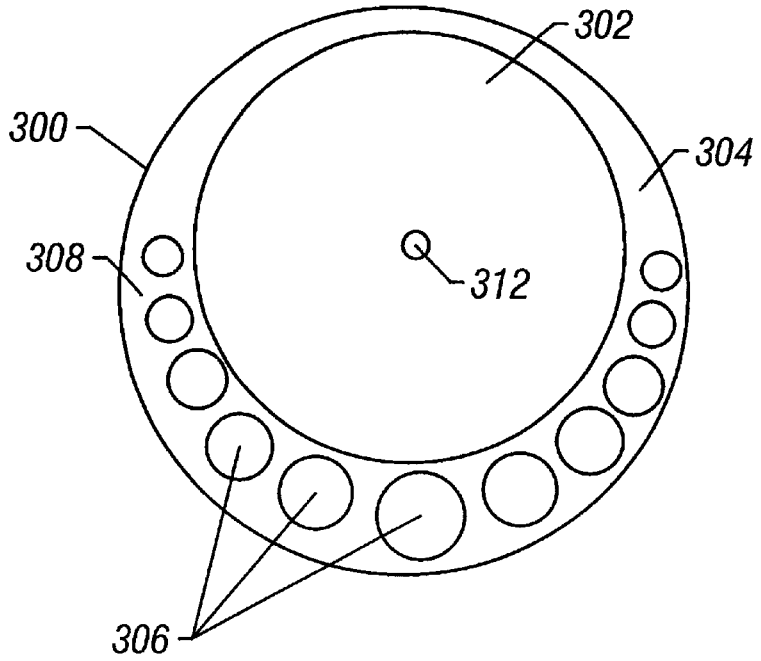
FIG. 22 illustrates a cross-section of the flow bypass housing.
Figure 23:
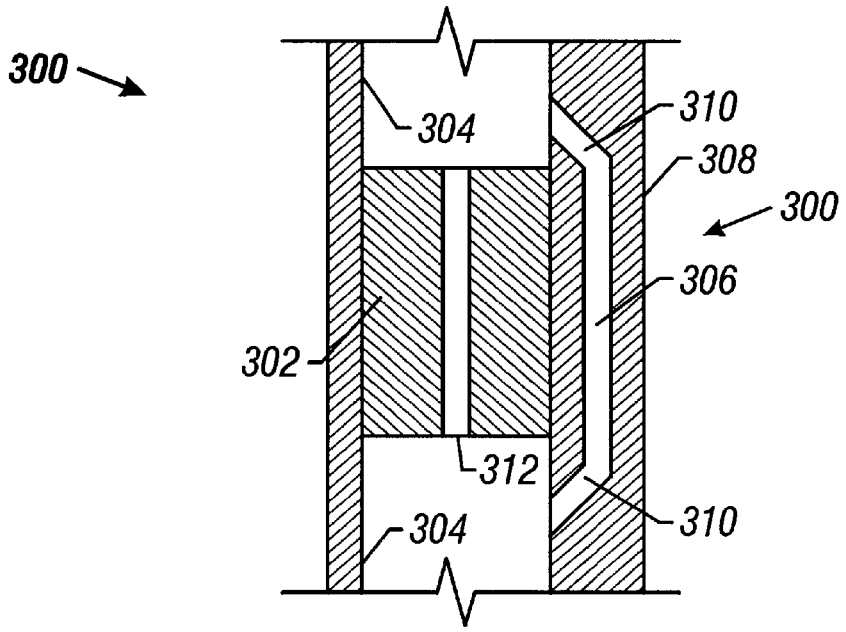
FIG. 23 illustrates a longitudinal section of the flow bypass housing.

FIGS. 22 and 23 illustrate a bypass flow housing 300 that may be utilized with tool string 10 or 220 in order to accommodate equipment 302. Equipment 302 may comprise a variety of downhole equipment including electronic equipment, such as fluid identifiers or other sensors or meters. Bypass flow housing 300 includes an eccentric main bore 304 as well as a plurality of bypass channels 306 disposed between the main bore 304 and the outer surface 308 of the housing 300. Each channel 306 has two ends 310, each end 310 communicating with the main bore 304. Equipment 302 is disposed intermediate the channel ends 310.

In use, housing 300 is integrated into the tool string 10 or 220. Fluid flow passing through tool string 10 or 220 enters housing 300 through main bore 304, passes through channels 306 by way of ends 310, and exits housing 300 through main bore 304. Thus, the fluid flow bypasses equipment 302. The shape and relative placement of the channels 306 in relation to the main bore 304 allows the wall thickness of the channels 306 to remain substantially thick enough to enable and withstand the high pressure flow rate through tool string 10 or 220. Thus, bypassing equipment 302 is achieved without sacrificing flow rate. It is noted that depending on the identity of the equipment 302, equipment 302 may allow the passage of fluid therethrough by way of port(s) 312.

While the invention has been disclosed with respect to a limited number of embodiments, those skilled in the art will appreciate numerous modifications and variations therefrom. It is intended that the appended claims cover all such modifications and variations as fall within the true spirit and scope of the invention.

I claim:

1. A method for testing a well having a production zone and an injection zone, comprising:

producing fluid from the production zone into a tool string, the tool string including a compartment;

injecting the fluid from the tool string into the injection zone;

trapping a volume of dead fluid within the compartment; and removing the volume of dead fluid from the compartment once the tool string is retrieved to the surface, wherein removing the volume of dead fluid comprises engaging surface equipment to the tool string to force the dead fluid from the compartment.

2. The method of claim 1, further comprising monitoring oil content of the fluid.

3. The method of claim 1, further comprising detecting solids contained in the fluid.

4. The method of claim 1, further comprising monitoring a density of the fluid.

5. The method of claim 1, wherein engaging the surface equipment comprises engaging a valve assembly.

6. The method of claim 5, wherein engaging the valve assembly comprises engaging a valve assembly having a stuffing box, a piston, and a conduit.

7. The method of claim 5, further comprising activating a pressure source in the surface equipment to force the dead fluid out of the compartment.

8. A method for testing a well having a production zone and an injection zone, comprising:

producing fluid from the production zone into a tool string, the tool string including a compartment;

injecting the fluid from the tool string into the injection zone;

trapping a volume of dead fluid within the compartment;

removing the volume of dead fluid from the compartment once the tool string is retrieved to the surface; and measuring the volume of any gas trapped within the compartment.

9. A method for testing a well having a production zone and an injection zone, comprising:

producing fluid from the production zone into a tool string, the tool string including a compartment;

injecting the fluid from the tool string into the injection zone;

trapping a volume of dead fluid within the compartment;

removing the volume of dead fluid from the compartment once the tool string is retrieved to the surface; and venting any gas trapped within the compartment prior to the removal of the volume of dead fluid from the compartment.

10. The method of claim 9, wherein the venting step comprises attaching a vent valve to the tool string and allowing any gas trapped within the compartment to vent through the vent valve.

11. The method of claim 10, further comprising:

transferring the volume of dead fluid from the compartment into at least one container.

12. A method for testing a well having a production zone and an injection zone, comprising:

producing fluid from the production zone into a tool string, the tool string including a compartment;

injecting the fluid from the tool string into the injection zone;

trapping a volume of dead fluid within the compartment; and removing the volume of dead fluid from the compartment once the tool string is retrieved to the surface, wherein the removing step comprises:

attaching a valve assembly to the tool string, the valve assembly including a piston and a conduit, the conduit disposed through the piston; and sliding the piston within the compartment towards the dead fluid thereby forcing the fluid to pass into the conduit.

13. The method of claim 12, wherein the piston is slidably disposed on the conduit.

14. A method for testing a well having a production zone and an injection zone, comprising:

producing fluid from the production zone into a tool string, the tool string including a compartment;

injecting the fluid from the tool string into the injection zone;

trapping a volume of dead fluid within the compartment; and removing the volume of dead fluid from the compartment once the tool string is retrieved to the surface, wherein the removing step comprises:

attaching a valve assembly to the tool string, the valve assembly including a piston and a passage;

positioning the piston so that a majority of the dead fluid is intermediate the piston and the passage; and sliding the piston towards the passage thereby forcing the dead fluid to pass into the passage.

15. A method for testing a well having a production zone and an injection zone, comprising:

producing fluid from the production zone into a tool string, the tool string including a compartment;

injecting the fluid from the tool string into the injection zone;

trapping a volume of dead fluid within the compartment; and removing the volume of dead fluid from the compartment once the tool string is retrieved to the surface, wherein the removing step comprises:

attaching a valve assembly to the tool string, the valve assembly including a conduit and a passage; and injecting a pressurized fluid through the conduit and into the compartment wherein the pressurized fluid forces the dead fluid out of the compartment through the passage.

16. A method for testing a well having a production zone and an injection zone, comprising:

producing fluid from the production zone into a tool string, the tool string including a compartment;

injecting the fluid from the tool string into the injection zone;

trapping a volume of dead fluid within the compartment; and removing the volume of dead fluid from the compartment once the tool string is retrieved to the surface, wherein the removing step comprises:

attaching a valve assembly to the tool string, the valve assembly including a conduit and a passage; and injecting a pressurized fluid through the passage and into the compartment wherein the pressurized fluid forces the dead fluid out of the compartment through the conduit.

17. A method for testing a well having a production zone and an injection zone, comprising:

producing fluid from the production zone into a tool string, the tool string including a compartment;

injecting the fluid from the tool string into the injection zone;

trapping a volume of dead fluid within the compartment;

removing the volume of dead fluid from the compartment once the tool string is retrieved to the surface;

monitoring a characteristic of the fluid produced from the production zone; and activating at least one sampler apparatus to take a sample of fluid.

18. The method of claim 17, wherein activating the at least one sampler apparatus to take the sample is separate from trapping the volume of dead fluid within the compartment.

19. The method of claim 17, wherein trapping the volume of dead fluid in the compartment comprises trapping in a compartment having a volume larger than that of the sampler apparatus.

* * * * *